US008011282B2

(12) United States Patent
Yoshimaru

(10) Patent No.: US 8,011,282 B2
(45) Date of Patent: Sep. 6, 2011

(54) SHEET PROCESSING DEVICE, IMAGE FORMING APPARATUS, AND SHEET PROCESSING METHOD

(75) Inventor: Akito Yoshimaru, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 305 days.

(21) Appl. No.: 12/007,309

(22) Filed: Jan. 9, 2008

(65) Prior Publication Data

US 2008/0168873 A1 Jul. 17, 2008

(30) Foreign Application Priority Data

Jan. 11, 2007 (JP) ..... 2007-003761

(51) Int. Cl.
*B26F 1/02* (2006.01)

(52) U.S. Cl. ..... 83/100; 83/167; 83/687

(58) Field of Classification Search ..... 83/100, 83/167, 687, 691; 15/347
See application file for complete search history.

(56) References Cited

U.S. PATENT DOCUMENTS

| | | | | | |
|---|---|---|---|---|---|
| 1,969,770 | A * | 8/1934 | Taylor | 83/100 |
| 1,986,725 | A * | 1/1935 | Granstedt | 83/100 |
| 2,335,981 | A * | 12/1943 | Watson | 234/79 |
| 2,707,028 | A * | 4/1955 | Burton | 83/100 |
| 2,968,982 | A * | 1/1961 | Cousino | 83/262 |
| 3,041,905 | A * | 7/1962 | Gerhard | 83/100 |
| 3,175,443 | A * | 3/1965 | Kettnich et al. | 83/100 |
| 4,547,206 | A * | 10/1985 | Sovis et al. | 96/342 |
| 5,032,155 | A * | 7/1991 | Wiese et al. | 96/406 |
| 5,235,884 | A * | 8/1993 | Magnuson | 83/100 |
| 5,253,030 | A * | 10/1993 | Shigemura et al. | 399/407 |
| 5,311,638 | A * | 5/1994 | Furcron et al. | 15/321 |
| 5,412,837 | A * | 5/1995 | Worwag | 15/353 |
| 6,029,309 | A * | 2/2000 | Imamura | 15/319 |
| 6,508,618 | B2 * | 1/2003 | Berfield | 415/56.2 |
| 6,622,908 | B2 * | 9/2003 | Fukumoto et al. | 234/98 |
| 7,303,613 | B2 * | 12/2007 | Rosenzweig | 96/421 |

(Continued)

FOREIGN PATENT DOCUMENTS

JP 10-310317 11/1998

(Continued)

OTHER PUBLICATIONS

Office Action for corresponding Japanese patent application No. 2007-003761 dated Mar. 22, 2011.

*Primary Examiner* — Keneth E. Peterson
(74) *Attorney, Agent, or Firm* — Harness, Dickey & Pierce, P.L.C.

(57) ABSTRACT

A sheet processing device having punch processing device(s) for punch-processing on a conveyed sheet member and a punch-scrap storage box for storing punch scraps therein that are produced by the punch processing and dropped from the punch-processing device(s) having an increased storing capacity of punch scraps, including a punch-scrap storage box constituting an air distribution duct having a punch-scrap suction inlet and an air discharge outlet; and air-sucking device(s) (fan) arranged on the most downstream side in the air discharge outlet of the air flowing direction for conveying the punch scraps produced by the punch processing device(s). Air is sucked by the fan so as to catch the punch scraps with punch-scrap separating device(s) arranged on the upstream side of the air flowing direction of the fan so that the punch scraps are heaped within the punch scrap storage box.

11 Claims, 19 Drawing Sheets

U.S. PATENT DOCUMENTS

| | | | | |
|---|---|---|---|---|
| 7,387,059 | B2 * | 6/2008 | Kobayashi | 83/684 |
| 7,461,578 | B2 * | 12/2008 | Tamura et al. | 83/147 |
| 2006/0128543 | A1 | 6/2006 | Sekine et al. | |
| 2006/0288516 | A1 * | 12/2006 | Sawalski | 15/320 |

FOREIGN PATENT DOCUMENTS

| | | |
|---|---|---|
| JP | 3195541 | 6/2001 |
| JP | 2001-315094 | 11/2001 |
| JP | 3282983 | 3/2002 |
| JP | 2003-117893 | 4/2003 |
| JP | 2003-170393 | 6/2003 |
| JP | 2005-154134 | 6/2005 |
| JP | 2005-194044 | 7/2005 |
| JP | 2005-254362 | 9/2005 |
| JP | 2005-274622 | 10/2005 |
| JP | 2006-150513 | 6/2006 |
| JP | 2006-151613 | 6/2006 |

* cited by examiner

SHEET PROCESSING DEVICE, IMAGE FORMING APPARATUS, AND SHEET PROCESSING METHOD

PRIORITY STATEMENT

This application claims benefit under 35 U.S.C. §119 to Japanese Patent Application No. 2007-003761, filed on Jan. 11, 2007 in the Japanese Patent Office, the entire contents of which is incorporated herein by reference.

BACKGROUND

1. Field

Embodiments of the present application generally relate to a sheet processing device for performing predetermined processing on a conveyed sheet member and carrying it out, an image forming apparatus having the sheet processing device, such as a copying machine, a printer, a facsimile machine, a digital complex machine having these compound functions, and/or a sheet processing method employed by the sheet processing device.

2. Description of the Related Art

In the image forming apparatus, such as the copying machine and the printer, there have been advances in multifunction, so that an image forming apparatus having a memory storing a large amount of images for forming images every section has become the mainstream. Also, along with the advances in multifunction, an image forming apparatus comes into being that includes a sheet post-processing unit for performing post-treatment, such as stack processing for stacking recorded sheets on a discharge tray while sorting the sheets, staple processing for stapling every predetermined number of the sheets and stacking on the discharge tray, and punch processing for punching the sheets for filing.

Among them, in the sheet post-processing unit having a punch function for punching sheets, the punch processing unit is arranged at an intermediate portion of a sheet conveying path so as to punch sheet during conveying the sheet. The punch processing unit generally includes a unit in that a punch and a die are arranged to oppose each other with a sheet therebetween so as to punch the sheet during conveying the sheet by inserting the punch head into the hole of the die.

In such a sheet post-processing unit, a punch scrap storage box (storage part) is arranged below the punch processing unit for receiving dropping punch scraps. At an upper portion of the punch scrap storage box, a full-space detection sensor is generally provided for informing an operator about the full space prompting its handling when the box is fully filled with the scraps.

When the punch scraps are going to drop into the box, the punch scraps are heaped around the scrap dropping point (just under the punch processing unit) as a center, so that the scraps are heaped in a chevron shape around the scrap dropping point. At this time, the scraps are concentrated only in the vicinity of the scrap dropping point and the scraps are difficult to heap at places separated from the dropping point. As a result, the storing efficiency of the punch scrap storage box is reduced as well as the scraps are spilled out from the apex of the scrap heap due to the falling down.

Then, in the sheet post-processing unit, the flattening of the punch scraps has been performed within the punch scrap storage box.

The technique for flattening the punch scraps includes:

1) The punch scraps are flattened by knocking them from outside the punch scrap storage box to apply vibration them;

2) By providing a hopper pin or a sheet within the punch scrap storage box, the dropping punch scraps are dispersed not to concentrate on the center;

3) A mobile punch scrap flattening mechanism is provided between the punch processing unit and the punch scrap storage box for dispersing the dropping directions of the punch scraps. As such known techniques, there are several disclosed inventions.

Even when preventing the operational interference due to the punch scraps by flattening scraps in such manners or by promptly informing the full space to prompt an operator to clear out the punch scrap storage box by detecting the full space, the punch scrap storage box must be arranged just under the punch processing unit, so that for securing the storage capacity of the punch scrap storage box, the box is needed to be deep.

Hence, it is necessary to ensure a large space just under the punch processing unit. Additionally, it is difficult to arrange the punch processing unit on the downstream side of the sheet post-processing unit. Furthermore, when the punch processing unit is arranged in the inner part of the sheet post-processing unit, the punch scrap storage box with large capacity has to be also arranged in the inner part, reducing work efficiency when the box is dragged out of the sheet post-processing unit as well as limiting the layout in ensuring a large space for operation after the box is dragged out.

SUMMARY

In at least one embodiment of the present application, a sheet processing device includes a punch processor to perform punch-processing on a conveyed sheet member; a punch-scrap storage box to store punch scraps produced by the punch-processing and dropped from the punch processor; and an air-blower to convey the punch scraps produced by the punch processor.

In at least one other embodiment of the present application, a sheet processing device includes a punch processor to perform punch-processing on a conveyed sheet member; a punch-scrap storage box to store punch scraps therein produced by the punch-processing and dropped from the punch processor; and an air-sucker to convey the punch scraps produced by the punch processor.

In at least one other embodiment of the present application, a sheet processing method in a sheet processing device, having for a punch processor to perform punch-processing on a conveyed sheet member and a punch-scrap storage box to store punch scraps produced by the punch processing and dropped from the punch processor, includes forming airflow by compulsively supplying air into the punch-scrap storage box; conveying punch scraps dropped from the punch processor with air; at least one of stopping the air supplying and suppressing the supplying air amount before the punch scraps are separated from air on a most downstream side of the airflow direction in the punch-scrap storage box; and uniformly heaping the punch scraps on the bottom of the punch scrap storage box.

DESCRIPTION OF THE PREFERRED EMBODIMENTS

Figure 1:
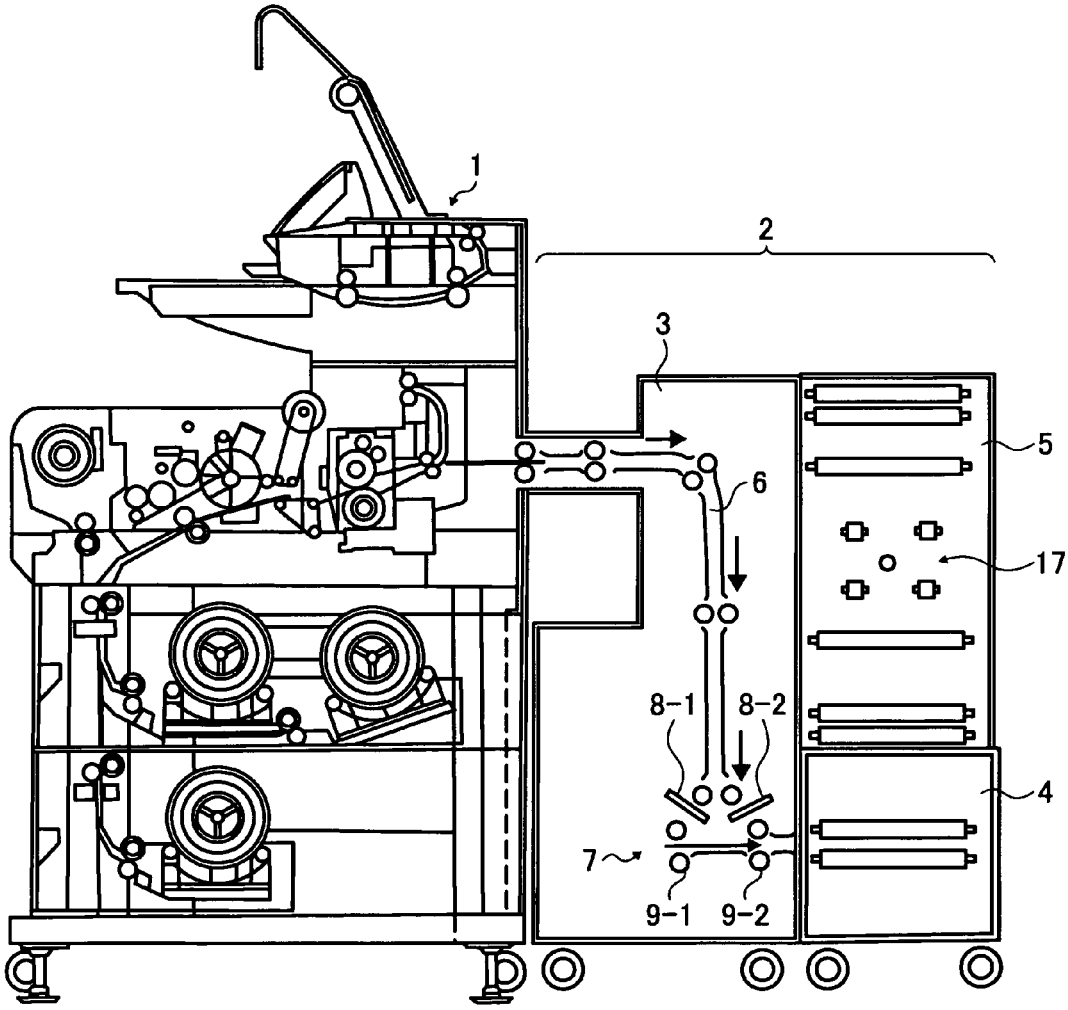
FIG. 1 is a schematic system structural view of an image forming apparatus and a sheet post-processing unit connected to the apparatus according to an embodiment of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

Embodiments of the present invention will be described below with reference to the drawings.

FIG. 1 is a schematic structural view of an image forming apparatus and a sheet post-processing unit connected to the apparatus according to an embodiment of the present invention. Referring to FIG. 1, the sheet post-processing unit 2 is composed of three devices differently functioning respectively, a bellows folding device 3, a conveying device 4, and a cross folding device 5. The respective functions will be simply described in a case where sheets with A0 size (Japanese Industrial Standards) are vertically outputted from the image forming apparatus 1. According to the embodiment, a sheet member is defined as a sheet recording medium having images recorded thereon such as recording paper, transfer paper, and an OHP sheet; the embodiment will be herein described with a sheet as a typical example.

A sheet with Ao length size outputted from the image forming apparatus 1 is conveyed in the bellows folding device 3. Then, the sheet arrives at a bellows folding unit 7 along a sheet transfer path 6. The bellows folding unit 7 includes two pairs of bellows folding blades 8-1 and 8-2 and two pairs of bellows folding rollers 9-1 and 9-2. The sheet with Ao length size is alternately creased by the bellows folding blades 8-1 and 8-2 while being conveyed in the right and left by the bellows folding rollers 9-1 and 9-2 so as to be finally bellows-folded into A4 width size compactly from A0 length size. In this process, the width of the sheet is maintained in A0 width size. The bellows-folded sheet is then conveyed in the conveying switch device 4.

Figure 2:
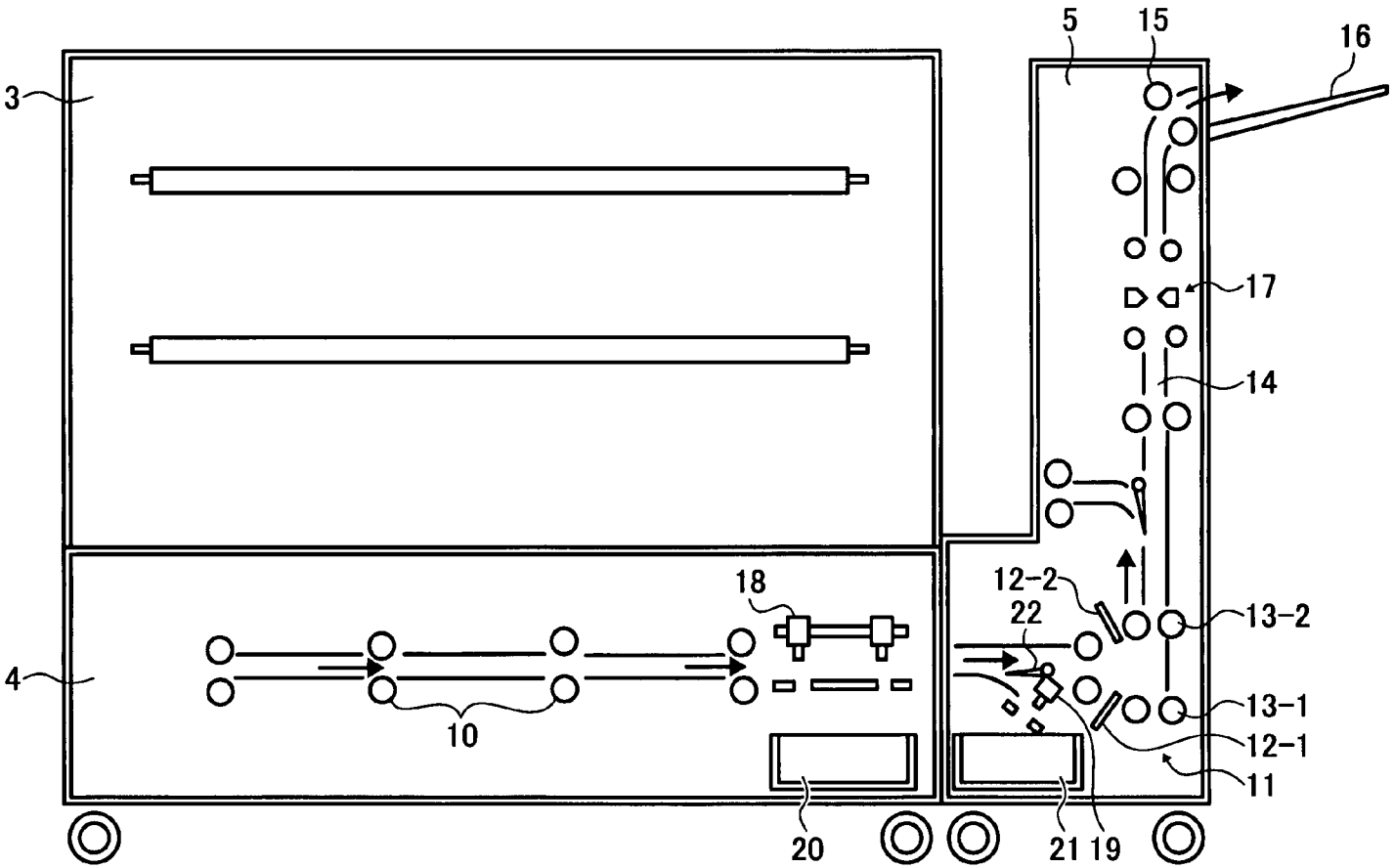
FIG. 2 is a schematic system structural view of the sheet post-processing unit of FIG. 1 viewed from the rear.

FIG. 2 is a schematic structural view of the sheet post-processing unit 2 viewed from the rear. The conveying direction of the bellows-folded sheet is switched by 90° with a conveying-switch roller group 10 and conveyed to the cross folding device 5 from the conveying switch device 4. The cross folding device 5 includes a cross folding unit 11 composed of two pairs of cross folding blades 12-1 and 12-2 and two pairs of cross folding rollers 13-1 and 13-2. The bellows-folded sheet entered in the cross folding unit 11 is alternately creased by the cross folding blades 12-1 and 12-2 while being conveyed up and down by the cross folding rollers 13-1 and 13-2 so as to be finally folded into A4 length from A0 width. Then, the sheet folded into the size of A4 length by A4 width is conveyed along a sheet transfer path 14 and discharged on a discharge tray 16 by discharge rollers 15.

The size of a sheet outputted from the image forming apparatus to require being folded widely ranges from A3 length and width, A1 length and width, to A0 length. Thus, when the sheet with a size of A1 width is outputted, for example, it is necessary that the sheet is bellows-folded into A4 length by the bellows folding unit 7 and the bellows-folded sheet is cross-folded into A4 width by the cross folding unit 11. In such a manner, in the case of the sheet with a width size, it is folded into a length size, which is rotated by 90°, so that the folded sheet is discharged after being rotated by 90° by a sheet rotation unit 17 arranged in front of the discharge rollers 15 of the cross folding device 5 so as to coordinate the direction of the folded sheet. The respective conveying switch device 4 and the cross folding device 5 include a punch processing unit.

As described above, the sheet size outputted from the image forming apparatus 1 includes a length size and a width size, so that the punching position is needed to be changed in accordance with the sheet size. Thus, a length punch treating unit 18 and a width punch treating unit 19 are provided. The length punch treating unit 18 is arranged in the vicinity of the outlet of the conveying switch device 4, and the bellows-folded sheet with a length size is detected by a sheet position detection sensor (not shown) to temporarily stop at a predetermined position. The folded sheet is punched by the length punch treating unit 18 at the position, and then conveyed to the cross folding device 5. The punch scraps produced in the length punch treating unit 18 drop into a length-punch scrap storage box 20 arranged just under the unit to be stored.

On the other hand, after the bellows-folded sheet with a width size enters the cross folding device 5, the transfer path is switched with a conveying switch claw 22, so that the leading end of the sheet is conveyed to the position of the width punch treating unit 19 for punching treatment. The punch scraps produced at this time freely fall into a width-punch scrap storage box 21 arranged just under the width punch treating unit 19 to be stored. After the punch treatment, the bellows-folded sheet with a width size is once switched back, and then the transfer path is switched with the conveying switch claw 22, so that the sheet proceeds toward the cross folding unit 11.

Figure 3A:
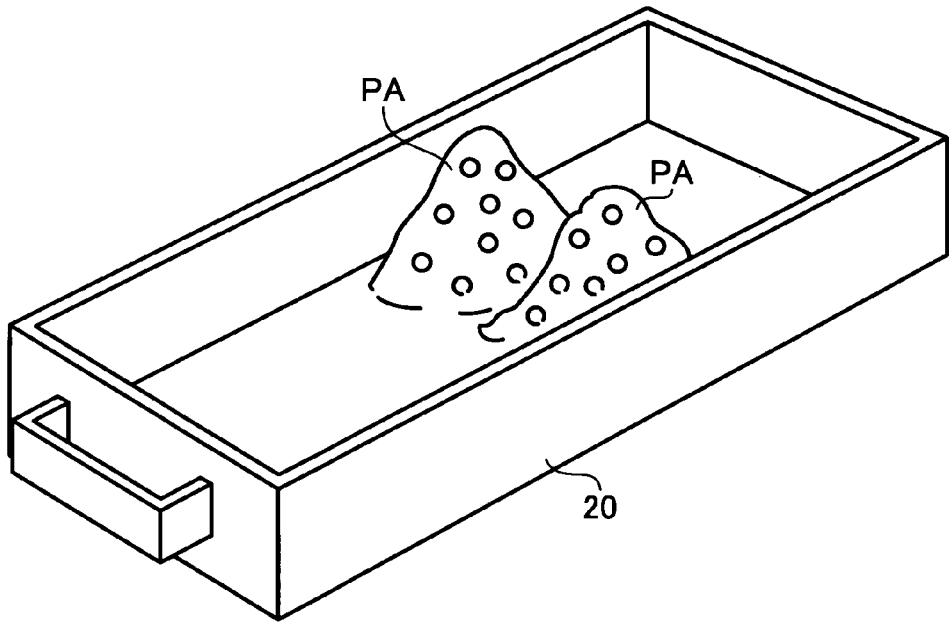
FIGS. 3A and 3B are drawings showing a storage state of punch scraps in a punch-scrap storage box.
Figure 3B:
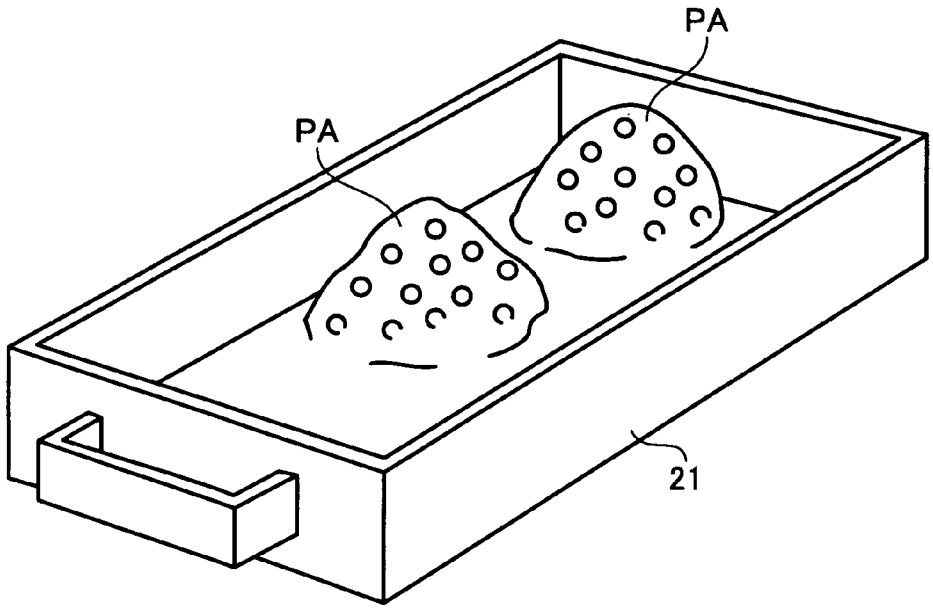

The sheet post-processing unit 2 according to the embodiment includes the length/width punch treating units having the length/width-punch scrap storage boxes, respectively, because the length/width punch treating units are separated from each other. Furthermore, since the length/width punch treating units 18 and 19 are located at comparatively lower positions of the sheet post-processing unit 2, the units 18 and 19 are near to the bottom of the sheet post-processing unit 2, so that the scrap storage boxes 20 and 21 have to be shallow. Hence, punch scraps PA, as shown in FIGS. 3A and 3B, are partly heaped in a chevron shape on the punch scrap storage boxes 20 and 21, so that a problem may arise in that the punch scraps PA may spill out of the boxes before the punch scrap storage boxes 20 and 21 are sufficiently filled with the punch scraps PA.

Then, according to the embodiment, the punch scraps PA can be efficiently stored within the punch scrap storage boxes 20 and 21 without spilling out of the boxes. Such embodiments will be described below.

First Embodiment

Figure 4:
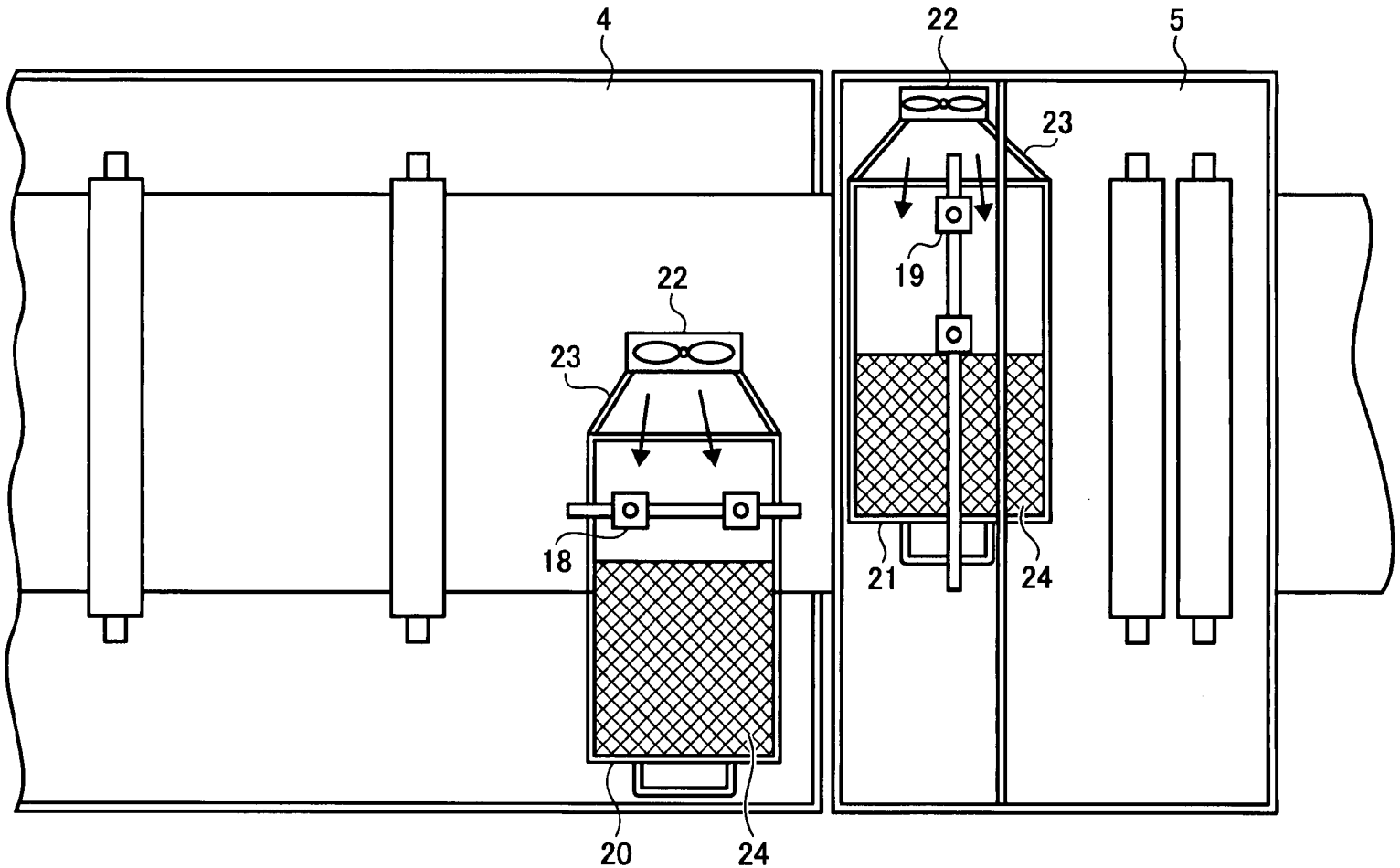
FIG. 4 is a plan view of essential parts of a conveying switch device and a cross folding device according to a first embodiment.
Figure 5:
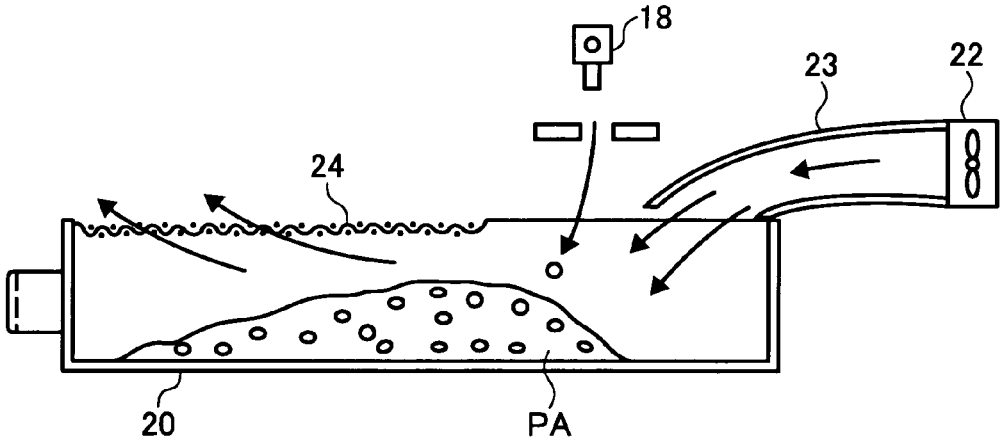
FIG. 5 is a schematic side view of the internal structures of a length-punch scrap storage box and a width-punch scrap storage box.

FIG. 4 is a plan view of essential parts of a conveying switch device 4 and a cross folding device 5 according to a first embodiment; and FIG. 5 is a schematic side view of the internal structures of the length-punch treating unit 18 and the length-punch scrap storage box 20. The structures of the width-punch treating unit 19 and the width-punch scrap storage box 21 are similar to those for the length punch, so that they will be omitted.

According to the embodiment, fans 22 are arranged in the rear of the length/width-punch scrap storage boxes 20 and 21, respectively, as air blowing device(s). Blowing ducts 23 are provided at positions on the downstream side of the blowing directions of the fans 22 for leading airflow produced by the fans 22 to the length/width-punch scrap storage boxes 20 and 21, respectively. This airflow pushes the punch scraps PA on the near side (downstream of the blowing direction) for leveling the heaped scraps. Thereby, the punch scraps PA are flattened, enabling the capacities of the punch scrap storage boxes 20 and 21 to be efficiently used.

In parts of regions above the punch scrap storage boxes 20 and 21, mesh covers 24 are provided for preventing the punch scraps from passing therethrough while allowing air to pass therethrough, so that when the blowing punch scraps PA are caught with the mesh cover 24, even if the air flow or the air speed is increased, the punch scraps PA cannot be blown out, thereby efficiently storing the punch scraps PA within the punch scrap storage boxes 20 and 21.

According to the embodiment, by conveying the punch scraps PA produced in the punch treating unit with air by the air blowing device(s) (the fan 22), the punch scraps PA, which have been heaped on the punch scrap storage boxes 20 and 21 due to free dropping, can be flattened by the air agitation. As a result, the capacity of the punch scrap storage box can be increased.

Second Embodiment

Figure 6:
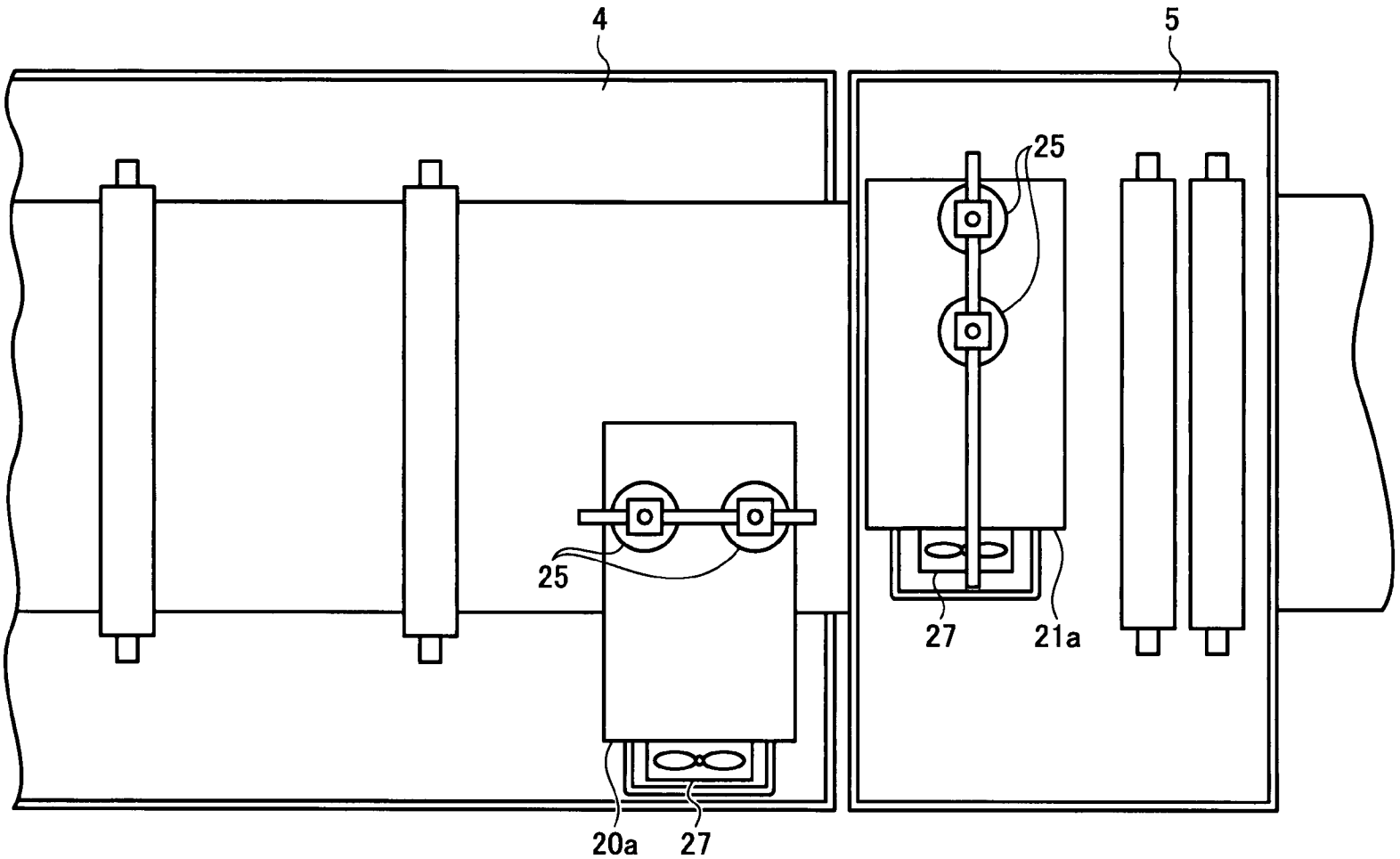
FIG. 6 is a plan view of essential parts of a conveying switch device and a cross folding device according to a second embodiment.
Figure 7:
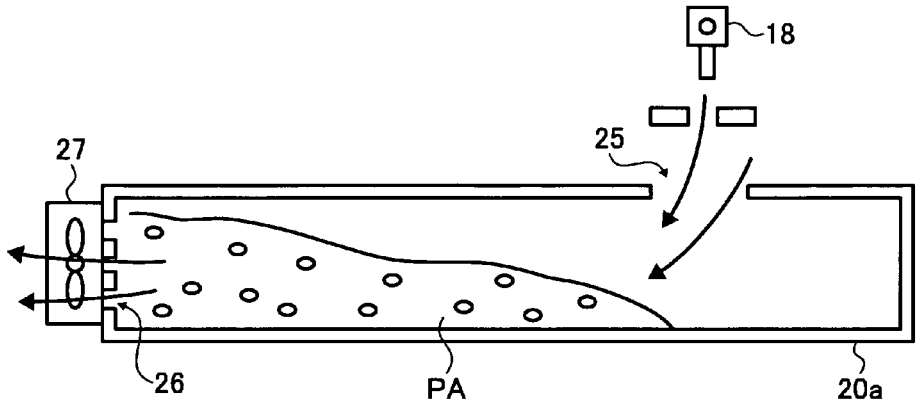
FIG. 7 is a schematic side view of the internal structures of a length-punch scrap treating unit and the length-punch scrap storage box.

FIG. 6 is a plan view of essential parts of a conveying switch device 4 and a cross folding device 5 according to a second embodiment; and FIG. 7 is a schematic side view of the internal structures of the length-punch treating unit 18 and a length-punch scrap storage box 20*a*.

According to the embodiment, the length-punch scrap storage box 20*a* includes a punch scrap suction inlet 25, an air discharge outlet 26, and a fan 27*a* arranged outside the air discharge outlet 26 as air sucking device(s). The length-punch scrap storage box 20*a* itself forms a blowing duct, and air enters the punch scrap suction inlet 25 to flow out of the air discharge outlet 26. The punch scraps PA are conveyed on airflow from the position of the punch treating unit toward the foreground so as to be packed up in the length-punch scrap storage box 20*a* from the foreground thereof, so that the capacity of the punch scrap storage box 20*a* can be increased.

In the first embodiment described above, the blowing airflow is not so directional so that the punch scraps PA are stirred in vain and difficult in being stored within the punch scrap storage boxes 20 and 21; whereas, according to the second embodiment, the air due to the suction produces the convergent air flow, so that the punch scraps PA can be efficiently stored in the length-punch scrap storage box 20*a*. This is the same as to the width-punch scrap storage box 21*a*.

According to the embodiment, each of the punch scrap storage box 20*a* and 21*a* forms the blowing duct having the punch scrap suction inlet 25 and the air discharge outlet 26, and by providing the air sucking device(s) (the fan 27*a*) in the air discharge outlet 26, the punch scraps PA can be packed in a shape of the punch scrap storage box so as to increase the storage capacity. Furthermore, by forming the respective punch scrap storage boxes 20*a* and 21*a* in a blowing duct shape closed except for at the inlet 25, the punch scraps PA can be prevented from dropping outside the punch scrap storage boxes 20*a* and 21*a* due to the collapse of the punch scraps PA.

Third Embodiment

Figure 8:
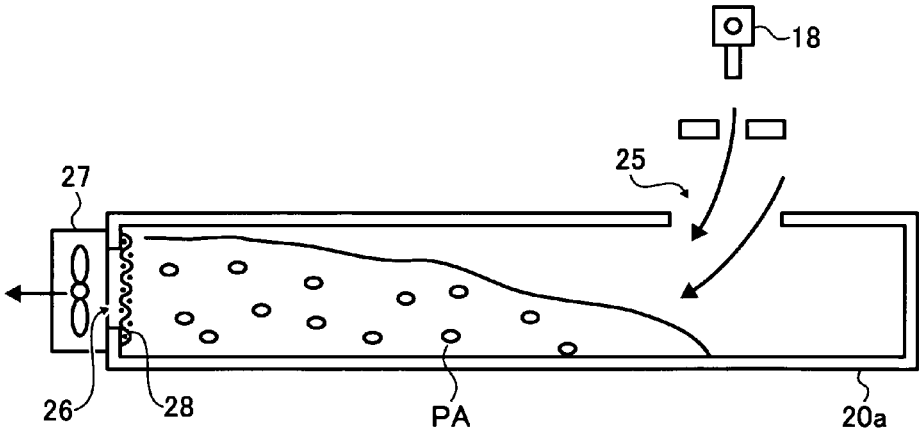
FIG. 8 is a schematic side view of the internal structure of a punch scrap storage box according to a third embodiment.

FIG. 8 is a schematic side view of the internal structure of punch scrap storage box 20*a* according to a third embodiment.

The punch scrap PA is generally a circular sheet scrap with a diameter of about 6 mm. According to the second embodiment, when the fan 27*a* takes air in, it sucks as well as the punch scraps PA, so that the punch scraps PA sucked together with the air may be blown out of the punch scrap storage box; whereas, according to the third embodiment, by providing punch scrap separating device(s) 28 at a position ahead the upstream side of the fan 27*a* of the length-punch scrap storage box 20*a* in the air flow direction for separating the punch scraps from air, the punch scraps PA are prevented from blowing out of the air discharge outlet 26.

The punch scrap separating device(s) 28 is formed of a mesh screen made of a metal, a mold, or paper for covering the air discharge outlet 26. The screen has about 2 mm-meshes, so that the circular punch scrap with a diameter of 6 mm can be prevented from passing through the screen even the scrap is folded into two. For preventing the clogging due to the attraction, the screen has a flat and smooth surface without a catch. For mostly preventing the reduction in blowing efficiency, the open area ratio is sufficiently increased. This is the same as in the width-punch scrap storage box 21*a*.

Other components are the same as those of the second embodiment unless otherwise specified.

According to the third embodiment, the punch scrap separating device(s) 28 is provided in front of the air blowing device(s), so that the blowing out of the punch scraps PA can be prevented so as to securely store the punch scraps PA into the punch scrap storage boxes 20*a* and 21*a*.

Fourth Embodiment

In this embodiment, air sucking controlling device(s) is provided for turning on/off the air sucking device(s) (fan) 27*a*.

Figure 9:
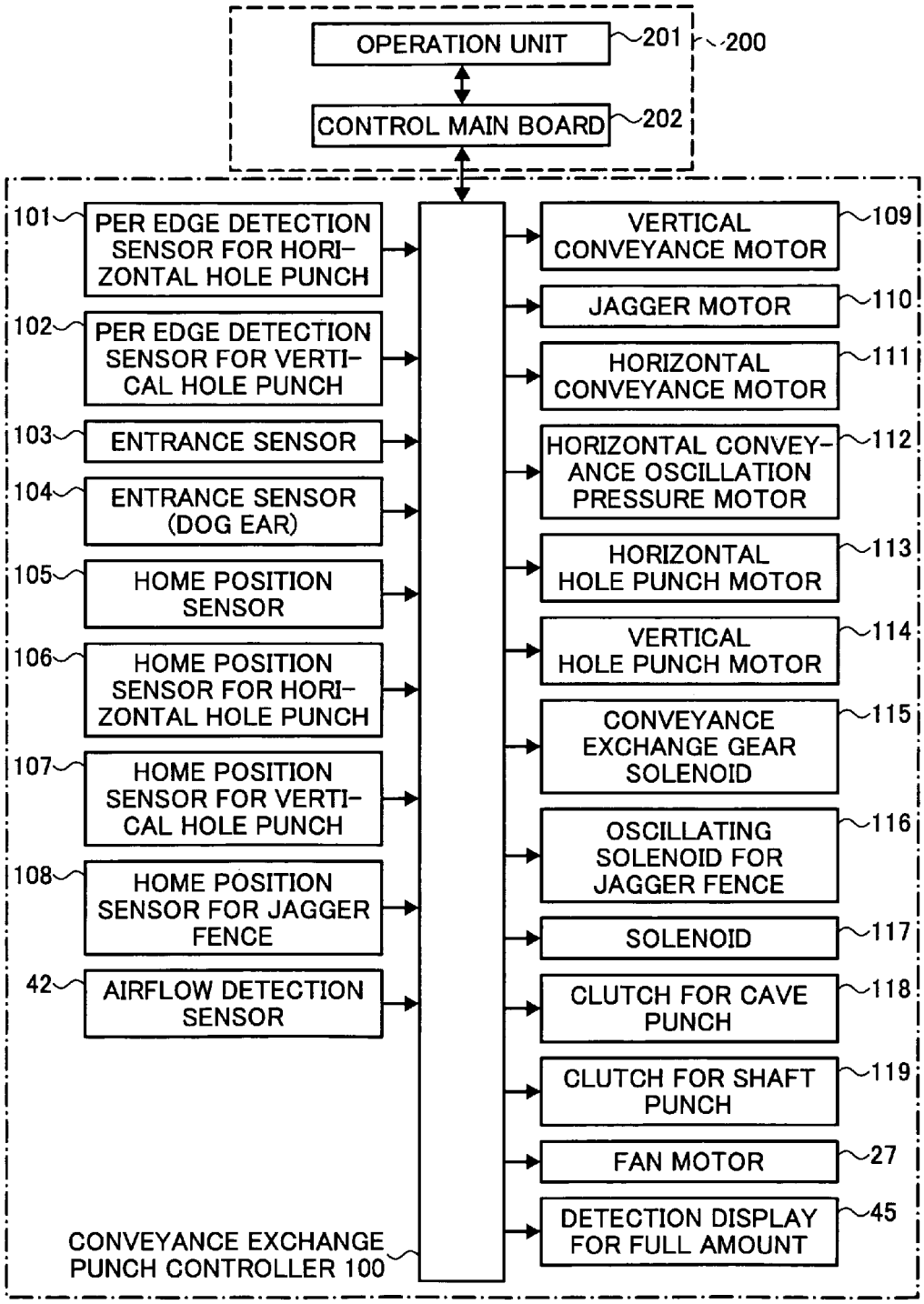
FIG. 9 is a block diagram of the electrical configuration of the system composed of the image forming apparatus and the sheet post-processing unit according to the embodiment.

FIG. 9 is a block diagram of the electrical configuration of the system composed of the image forming apparatus 1 and the sheet post-processing unit 2 according to the embodiment. In the copying machine body 1, an operation unit 201 and a main-frame control substrate 202 are provided. In the sheet post-processing unit 2, to a controller 100, there are connected a sheet leading-end detection sensor for a width punch 101, a sheet leading-end detection sensor for a length punch 102, an inlet sensor 103, an inlet sensor (end folding) 104, a home position sensor 105, a home position sensor for a width punch 106, a home position sensor for a length punch 107, a jogger-fence home position sensor 108, a vertically conveying motor 109, a jogger motor 110, a horizontally conveying motor 111, a horizontally conveying swing pressure motor 112, a side punch motor 113, a length punch motor 114, a conveying-switch jaw solenoid 115, a jogger-fence swing solenoid 116, a solenoid 117, a width punch clutch 118, a length punch clutch 119, a fan motor 27, an air flow detection sensor 42, and a full-space detection display 45. The controller 100 controls each drive component on the basis of the detected output from each sensor. This control is executed by a CPU (not shown) in accordance with the program stored in an RAM (not shown) using an FOM (not shown) as a work area.

The object of the air sucking device(s) includes the recovery of the punch scraps PA, so that the dropping punch scraps PA are conveyed in the length/width-punch scrap storage boxes 20*a* and 21*a* by the air flow produced by a fan 27 turned on only before and after the punch treating in accordance with the operation of the punch treating unit. After the punch scraps PA are further recovered in the length/width-punch scrap storage boxes 20*a* and 21*a* efficiently, the fan 27 is turned off, thus reducing the electric power consumption as well as preventing excessive packing of the punch scraps PA themselves due to the constant sucking. That is, if the punch scraps PA are excessively packed, the air permeability is reduced and the clogging is produced due to the adhesion of the punch scraps PA to the air discharge outlet 26, so that the sucking power is reduced; whereas, by preventing the excessive packing, the reduction in sucking power is prevented, thus increasing the storage capacity of the punch scraps PA.

Other components including the punch scrap storage box 20*a* are the same as those of the second or third embodiment unless otherwise specified.

According to the embodiment, by turning on/off the air sucking device(s) in such a manner, the punch scraps PA adhered to the air discharge outlet 26 can be securely dropped on the punch scrap storage boxes 20*a* and 21*a*, thus preventing the reduction in sucking power due to the clogging as well as reducing the electric consumption power.

Fifth Embodiment

Figure 10:
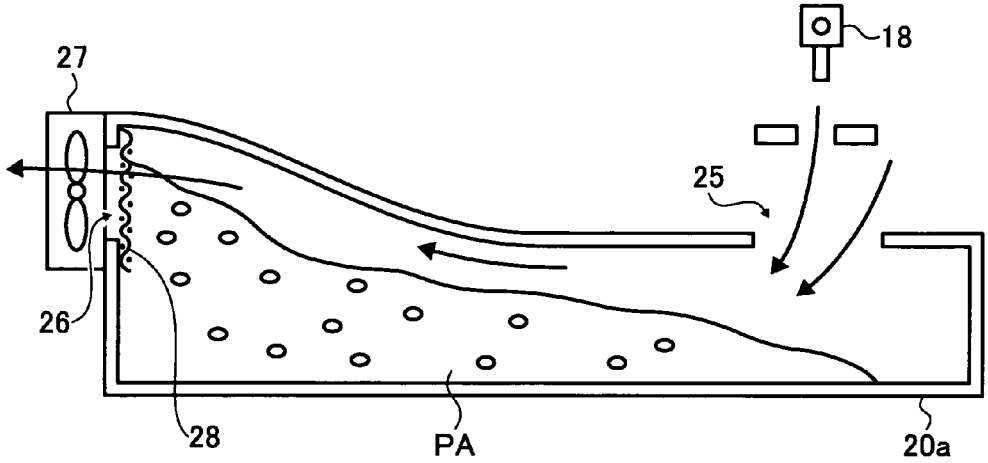
FIG. 10 is a schematic side view of the internal structure of a punch scrap storage box according to a fifth embodiment.

FIG. 10 is a schematic side view of the internal structure of punch scrap storage boxes 20*a* and 21*a* according to a fifth embodiment.

According to the second and third embodiments, the air discharge outlet 26 and the fan 27 are arranged on the foreground side wall of the length-punch scrap storage box 20*a*. If the air discharge outlet 26 and the fan 27 are provided at this position, when the punch scraps PA are recovered and heaped to some extent, the punch scraps PA themselves block off the air discharge outlet 26, resulting in reduction in sucking efficiency.

According to the fifth embodiment, for preventing such reduction in sucking efficiency due to the volume, the height of the foreground wall of the length-punch scrap storage box 20*a* is increased so that the air discharge outlet 26 and the air sucking device(s) (fan) 27*a* are arranged in the upper portion of the length-punch scrap storage box 20*a*. By arranging the air discharge outlet 26 and the air sucking device(s) (the fan 27) in the upper portion of the length-punch scrap storage box 20*a* in such a manner, even during the turning on of the fan 27, the punch scraps PA may adhere to the air discharge outlet 26, when the fan 27 is turned off, the punch scraps PA drop due to the self weight, so that the clogging is difficult to be generated. As a result, even when the punch scraps PA are heaped on the length-punch scrap storage box 20*a* to some extent, the reduction in sucking power is prevented so as to increase the storing capacity of the punch scraps PA. This is the same as in the width-punch scrap storage box.

The fan 27 starts turning-on before the punch scraps PA drop due to the punch treating, and is turned off just before the punch scraps PA arrive at the punch scrap separating device (s) 28 by being conveyed on the air flow when the clogging is not generated yet. Alternatively, the fan 27 is turned off until the punch scraps PA can drop without strongly adhering to the punch scrap separating device(s) 28 even they arrive at the punch scrap separating device(s) 28. In any way, the dropping and heaping period of the punch scraps PA is selected from between from the scrap dropping timing without air flow and the scrap arriving timing at the punch scrap separating device (s) 28.

Other components are the same as those of the second embodiment unless otherwise specified.

According to the embodiment, the air discharge outlets 26 and the air sucking device(s) (fan) 27*a* are arranged in the upper portions of the punch scrap storage boxes 20*a* and 21*a* so as to generate the air flow in the upper portions of the punch scrap storage boxes, so that the punch scraps PA drawn by the fan 27 freely drop when the fan 27 is turned off so as to be efficiently recovered in the punch scrap storage boxes as well as the reduction in sucking efficiency due to the re-sucking of the recovered punch scraps PA can be prevented.

Sixth Embodiment

Figure 11:
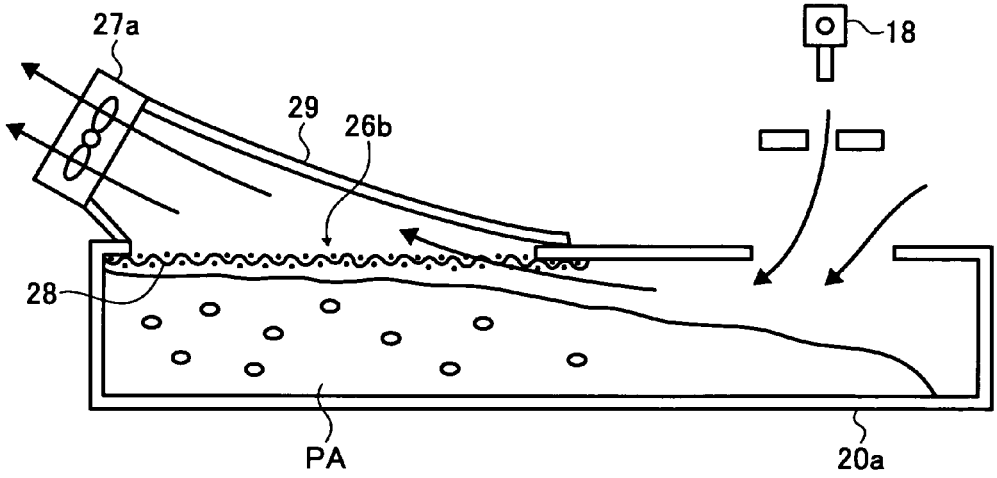
FIG. 11 is a side view of the internal structure of a punch scrap storage box according to a sixth embodiment.

FIG. 11 is a schematic side view of the internal structure of punch scrap storage boxes 20*a* and 21*a* according to a sixth embodiment.

According to the second, third, and fifth embodiments, since the opening of the air discharge outlet 26 is roughly the same in area as the air sucking device(s) (the fan 27), when the punch scraps PA are stored to some extent to increase their "bulk", the air discharge outlet 26 may be closed, reducing the sucking power.

Whereas, according to this embodiment, an air inducing duct 29 is provided so as to have the large opening of an air discharge outlet 26*b* on the upper surface of the length-punch scrap storage box 20*a*. By such a structure, since the large air discharge outlet 26*b* is ensured, the air flow is secured even after a plenty of the punch scraps PA are stored, so that the sucking power cannot be reduced so as to continue storing the punch scraps PA until the length-punch scrap storage box 20*a* is substantially fully filled with the punch scraps PA.

The discrete air sucking device(s) (fan) 27*a* and the air inducing duct 29 are separably provided from the length-punch scrap storage box 20*a*. By such a structure, the punch scraps PA can be put away by separating only the length-punch scrap storage box 20*a* from the conveying switch device 4 during discharging of the punch scraps PA. Thereby, the structure of the length-punch scrap storage box 20*a* is simplified, improving the operation efficiency during the discharging of the punch scraps PA. This is the same as in the width-punch scrap storage box 21*a*.

Other components are the same as those of the second embodiment unless otherwise specified.

According to the embodiment, since the air inducing duct 29 is provided in the rear of the air discharge outlet 26*b* as well as on the upstream side of the air flowing direction from the air sucking device(s) (fan) 27*a* so as to expand the opening of the air discharge-outlet 26*b*, the clogging can be prevented even when the punch scraps PA are heaped on the punch scrap storage box 20*a*, suppressing the reduction in sucking power.

Seventh Embodiment

Figure 12:
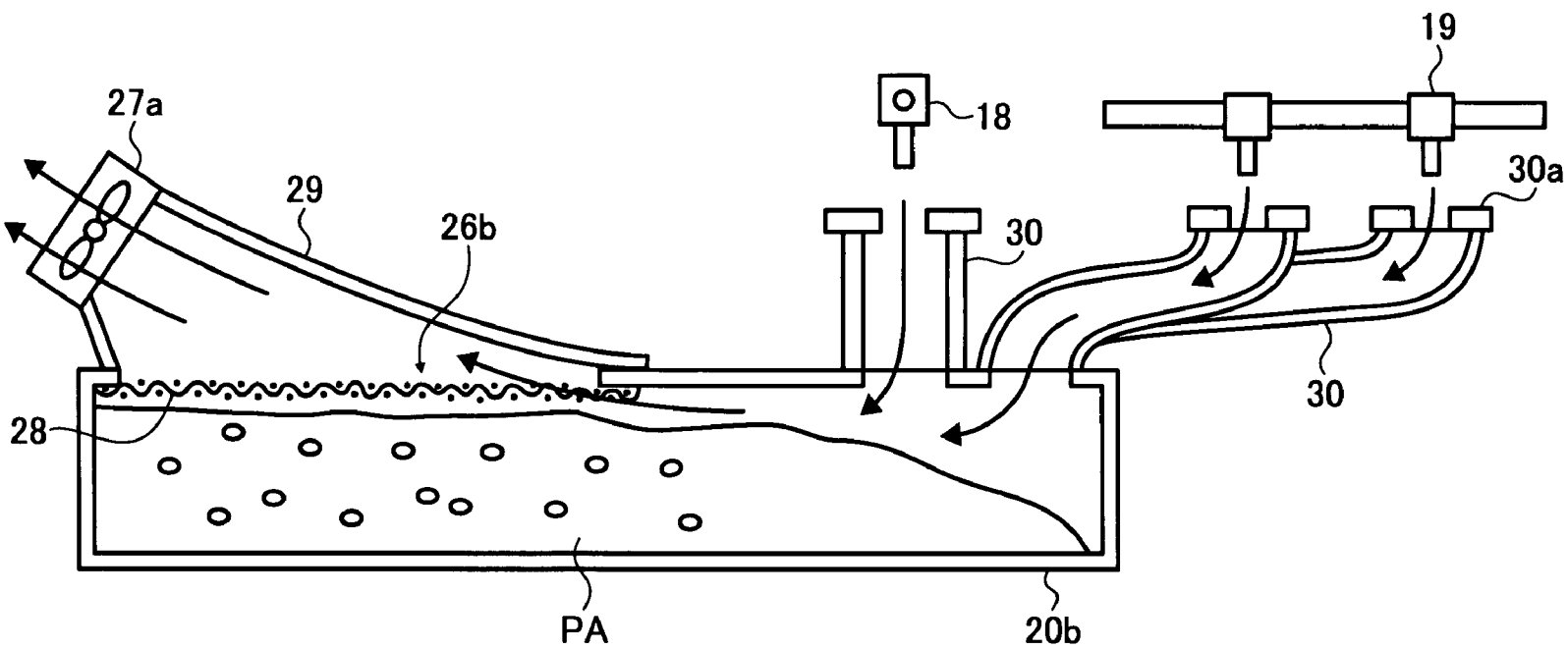
FIG. 12 is a side view of the internal structure of a punch scrap storage box according to a seventh embodiment.
Figure 13:
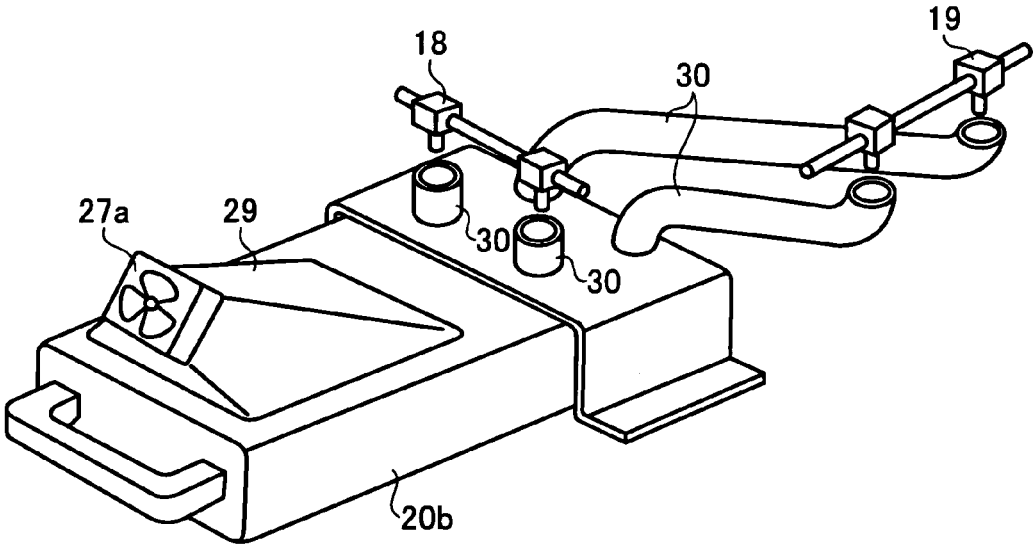
FIG. 13 is a perspective view of the structure of the punch scrap storage box according to the seventh embodiment.

FIG. 12 is a schematic side view of the internal structure of punch scrap storage boxes 20*a* and 21*a* according to a seventh embodiment; and FIG. 13 is a perspective view of the punch scrap storage boxes 20*a* and 21*a*.

According to the second, third, fifth, and sixth embodiments, since the length/width-punch treating units 18 and 19 are arranged separately from each other, the length/width-punch treating units 18 and 19 are provided with the punch scrap storage boxes 20*a* and 21*a* and the air sucking device(s) (fan) 27*a*, respectively. Therefore, the respective full-space detection sensors for the punch scraps PA (not shown) are also provided, and the discharging of the punch scraps PA is also separately executed. By doing so, the operation is doubled, resulting in being a burden to an operator and disadvantageous in cost.

Whereas, according to this embodiment, the punch scraps PA discharged from the length/width-punch treating units 18 and 19 are stored in common within a punch scrap storage box 20*b*, enabling the punch scraps PA to be discharged by one time operation.

Thus, according to the embodiment, punch-scrap relay conveying ducts 30 are provided for conveying the punch scraps PA from the length/width-punch treating units 18 and 19 to the common punch scrap storage box 20*b*. The punch-scrap relay conveying duct 30 is fixed to the conveying switch device 4 and the cross folding device 5, and structured separably from the common punch scrap storage box 20*b* during the discharge of the punch scraps. The inlet 30*a* of the duct 30 is arranged at a position just under and near the punch unit of the width-punch treating unit 19 so as to securely catch the discharged punch scraps PA.

By storing the length/width-punch scraps discharged from the length/width-punch treating units 18 and 19 in the common punch scrap storage box 20*b* in such a manner, the air sucking device(s) (fan) 27*a* and the full-space detection device(s) can be in common to the length/width-punch treating units (only one required for each), reducing cost as well as the burden to an operator because of the one time discharging. The air sucking device(s) (fan) 27*a* can be used in common, if a forked suction duct is added, also according to the second, third, fifth, and sixth embodiments.

Other components are the same as those of the sixth embodiment unless otherwise specified.

According to the embodiment, at least one punch-scrap relay conveying duct 30 is provided for conveying the punch scraps PA dropped from the length/width-punch treating units 18 and 19 through the air flow to the punch scrap storage box 20*b*, so that the reduction in sucking power due to the re-sucking of the recovered punch scraps can be prevented. Since the punch-scrap relay conveying duct 30 is separable from the punch scrap storage box 20*b*, the degree of freedom in arrangement of the punch treating units 18 and 19 and the punch scrap storage box 20*b* is increased, improving the operation efficiency of discharging the punch scraps. Furthermore, the cost of the expensive fan with its drive and control mechanism can be reduced by for one unit.

Eighth Embodiment

Figure 14:
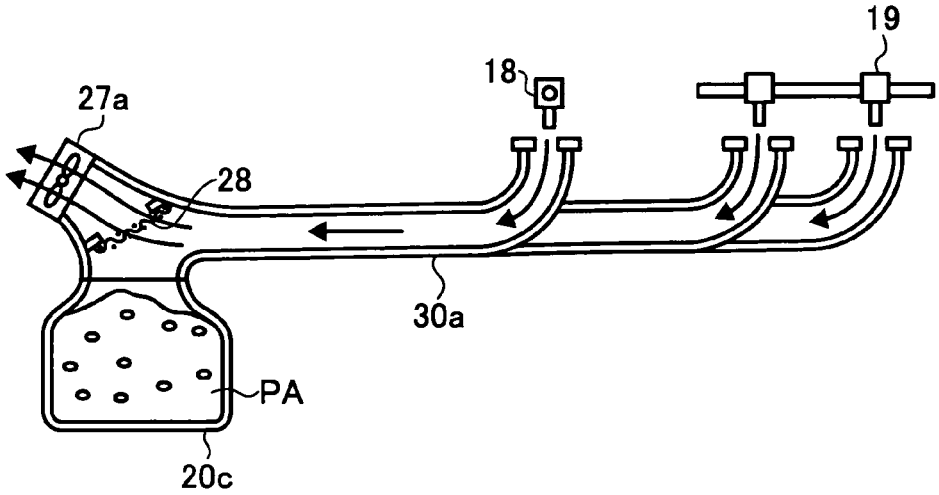
FIG. 14 is a side view of the internal structure of a punch-scrap storage-box recovering mechanism according to an eighth embodiment.

FIG. 14 is a side view of the internal structure of a punch scrap storage box recovery mechanism according to an eighth embodiment.

According to the second, third, fifth, sixth, and seventh embodiments, since the punch scrap storage box 20*a* or 20*b* also serves as a blowing duct, the stored punch scraps are re-sucked to block off the air discharge outlet 26, reducing the sucking power. Alternatively, the punch scraps PA may be whirling within the punch scrap storage box 20*a* or 20*b*, raising a problem that the accuracy of the full-space detection sensor is reduced. The punch scrap storage box 20*a*, 21*a*, or 20*b* is to be a long sideways box extending toward the punch treating unit 18 or 19 by necessity, leaving room for improving the detachability during the discharging of the punch scraps.

Thus, according to the embodiment, a punch-scrap relay conveying ducts 30*a* has the entire function to convey the length/width-punch scraps while a punch scrap storage box 20*c* has only the function to store the punch scraps PA.

According to the embodiment, before and after the operation of the length/width-punch treating units 18 and 19, the air sucking device(s) (fan) 27*a* is turned on by air sucking controlling device(s) so as to convey the punch scraps PA to the air discharge outlet 26*a*, so that the punch scraps PA adhere on the surface of the punch scrap separating device(s) 28. Since after sucking the punch scraps, the air sucking device(s) (fan) 27*a* is turned off by air sucking controlling device(s), the adhering punch scraps PA drop by the self weight on the punch scrap storage box 20*c* arranged just under the air discharge outlet 26*a*.

The air sucking device(s) (the fan 27*a*) is arranged above the punch scrap storage box 20*c* to direct air to flow in the lateral direction, and the punch scrap storage box 20*c* has an opening in a direction deviated from the air flow direction. Hence, the punch scraps PA once stored in the punch scrap storage box 20*c* cannot whirl up again so as to block off the air discharge outlet 26*a* or the punch scrap separating device(s) 28, so that the sucking power cannot be reduced.

Since the punch scrap storage box 20*c* functions only to recover the freely dropped punch scraps PA, the box can be formed in a bottle shape or in a paper bag. Thus, the cost can be reduced and the box can be arranged in the vicinity of the outer cover of the sheet post-processing unit 2, improving the operation efficiency during the discharging of the punch scraps.

According to the embodiment, the punch scrap storage box 20*c* is arranged at a position separated from the punch treating units 18 and 19 and below the air sucking device(s) (fan) 27*a*, so that the airflow passes above the opening of the punch scrap storage box 20*c* and the recovered punch scraps cannot be re-sucked, preventing the reduction in sucking power. Also, since the punch scrap storage box 20*c*, the air sucking device(s) (the fan 27*a*), and the punch-scrap relay conveying ducts 30*a* are separably constructed, the degree of freedom in the arrangement of the punch treating units 18 and 19 and the punch scrap storage box 20*c* is increased, and the structure of the punch scrap storage box 20*c* is further simplified, improving the operation efficiency during the discharging of the punch scraps.

Ninth Embodiment

According to the first to seventh embodiments, the problem of the flattening of the punch scraps and the limit in the layout are solved by conveying and recovering the punch scraps through the airflow.

On the other hand, in a conventional system for the full-space detection of the punch scraps, the mainstream one is a reflection or transmission optical sensor that detects the arrival of the punch scraps at a predetermined amount so as to inform an operator of the full-space of the punch scrap storage box for prompting its handling. At this time, it is easy to detect the full-space by detecting the arrival of the heaped punch scraps at a predetermined height with the optical sensor when a deep punch scrap storage box is arranged just under the punch treating unit. However, when the full-space of the long sideways punch scrap storage box with the punch scraps is detected in the same way as in the deep punch scrap storage box, for example, detection errors may occur because of the punch scraps that adhere to the front of the sensor or are heaped at a deviated position of the punch scrap storage box and whirled by the airflow before the full-space. Furthermore, since shapes of the stored punch scraps are different in accordance with the thickness of paper because of the various kinds of punched paper, the precise detection of the full-space has been difficult. Also, with increasing punch scraps stored in the punch scrap storage box, the sucking power is reduced because of the punch scraps narrowing the airflow path, so that board paper punch scraps may not be conveyed before the full-space.

Figure 15:
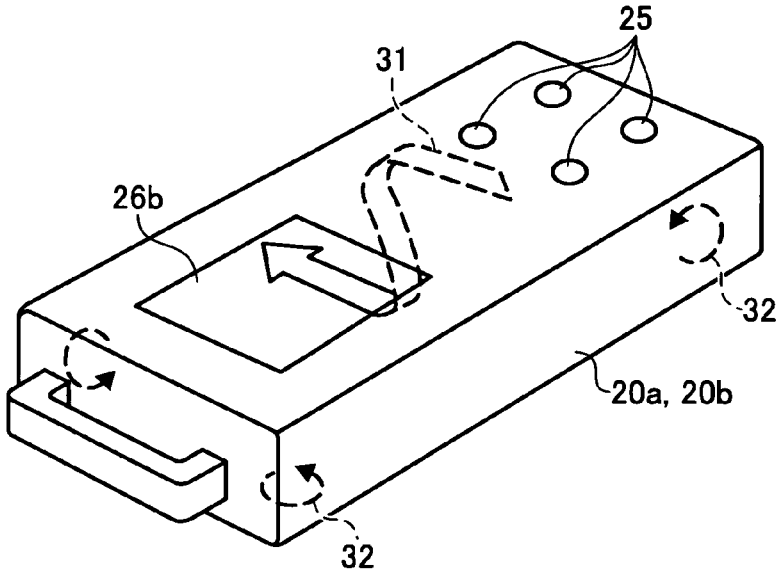
FIG. 15 is a schematic drawing showing the airflow flowing through a blowing duct, which is formed by the punch scrap storage box according to the second to seventh embodiment.

FIG. 15 is a schematic drawing showing the airflow flowing through the blowing duct, which is formed by the punch scrap storage boxes 20*a*, 21*a*, and 20*b* according to the second to seventh embodiment. According to these embodiments, an axial flow fan is used as the air sucking device(s), so that the whole airflow may be directed from the punch scrap suction inlet 25 toward the air discharge outlet 26*b*. However, when viewed more in detail, as shown in the drawing, a spirally wound flow 31 is generated that is proceeding while spirally rotating. Furthermore, since the punch scrap storage box 20*a* has a rectangular section, small eddy currents or turbulent airflows 32 are generated at four corners of the section.

Figure 18:
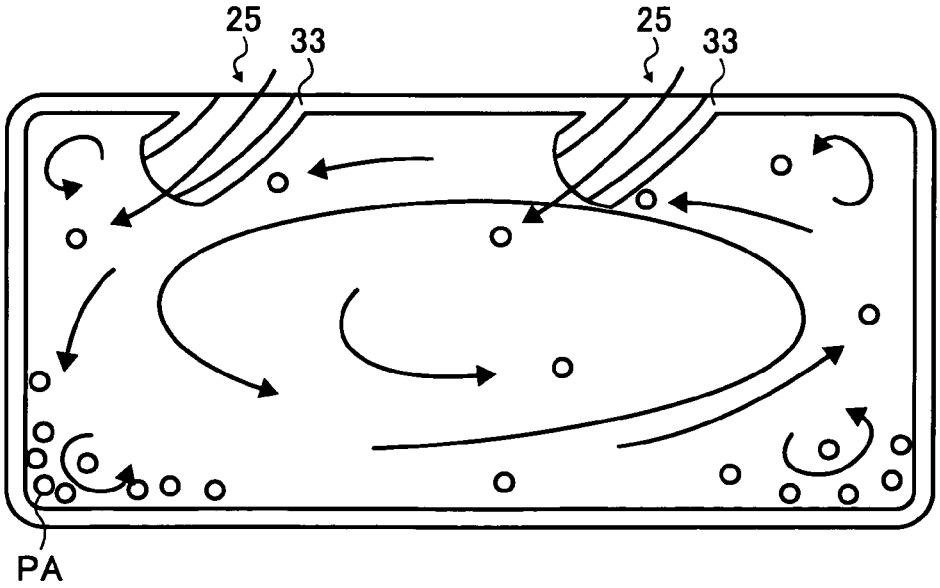
FIG. 18 is a drawing showing an airflow state within the punch scrap storage box after the provision of the punch scrap suction guide plate.

Hence, part of the punch scraps PA sucked from the punch scrap suction inlet 25 may proceed towards the air discharge outlet 26*b* not directly but by being bumped against the inner wall along the airflow. This is because while air can move in a rounded form along the outer shape of the duct because of the small specific weight, the punch scraps PA continue the rectilinear propagation by the inertial due to its mass. Each piece of the punch scrap PA is a flat sheet with a diameter of about 6 mm, and the direction of the received force varies time to time with the direction of its plane, so that the proceeding direction of the punch scraps does not necessarily agree with that of the airflow. Thus, the punch scraps PA once sucked from the punch scrap suction inlet 25, as shown in FIG. 18, may be blown out of the same punch scrap suction inlet 25 or another punch scrap suction inlet 25.

whereas, according to the embodiment, the punch scraps PA sucked from the punch scrap suction inlet 25 are prevented from being blown out of the same punch scrap suction inlet 25 or another punch scrap suction inlet 25.

Figure 16:
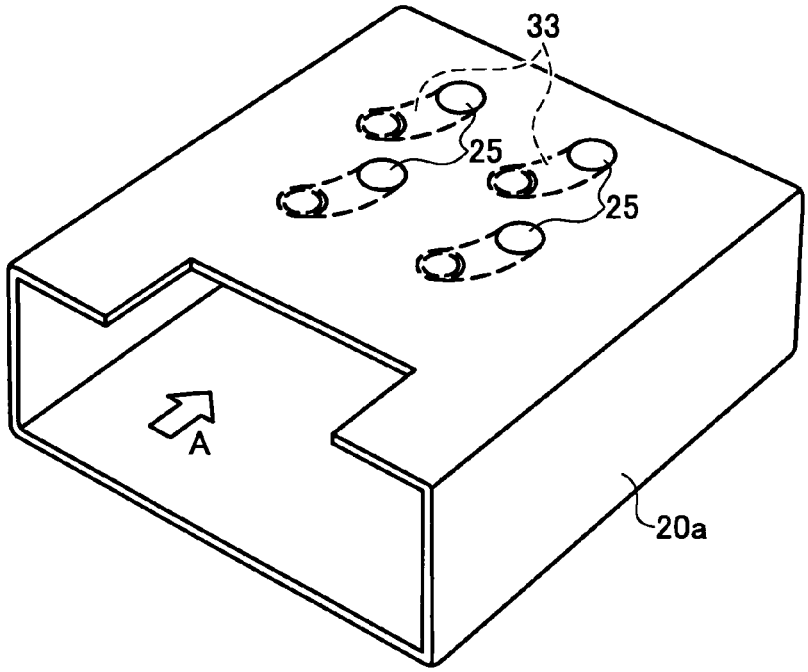
FIG. 16 is an exterior perspective view of the punch scrap storage box according to the embodiment.
Figure 17:
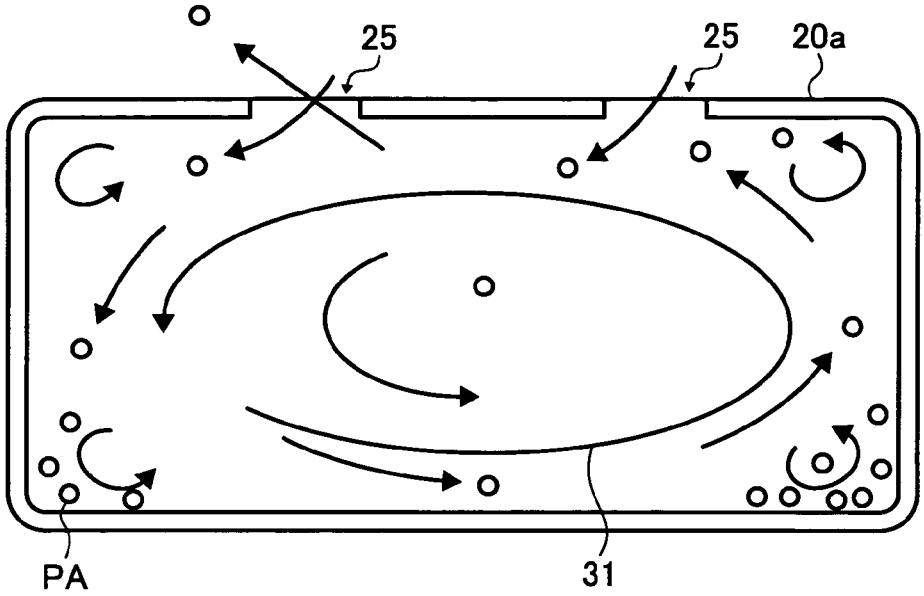
FIG. 17 is a drawing showing an airflow state within the punch scrap storage box before the provision of a punch scrap suction guide plate.

FIG. 16 is an exterior perspective view of a punch scrap storage box according to a ninth embodiment. According to the embodiment, the punch-scrap relay conveying ducts 30 or the punch scrap storage box 20*a*, or both of them are provided with opened punch scrap suction guide plates 33 connected to the punch scrap suction inlet 25. The punch scrap suction guide plate 33 prevents the punch scraps PA from being blown out in a direction of the spirally wound flow 31 by covering the punch scrap suction inlet 25. The punch scrap suction guide plate 33 is also constructed in angle and direction so that the punch scraps PA are smoothly sucked along the spirally wound flow. Due to the function of the punch scrap suction guide plate 33, as shown in FIG. 18, the blown out of the punch scraps PA is prevented for smoothly sucking them. FIGS. 17 and 18 are sectional views having added air flows and viewed from A direction of FIG. 16, showing the difference between the structure with the punch scrap suction guide plates 33 and the structure without them.

According to the embodiment, since the punch-scrap relay conveying ducts 30 or the punch scrap storage box 20*a*, or both of them are provided with the punch scrap suction guide plates 33, the punch scraps PA sucked through the punch scrap suction inlet 25 or the already stored punch scraps PA can be prevented from being blown out again from the punch scrap suction inlet 25.

Tenth Embodiment

Figure 19:
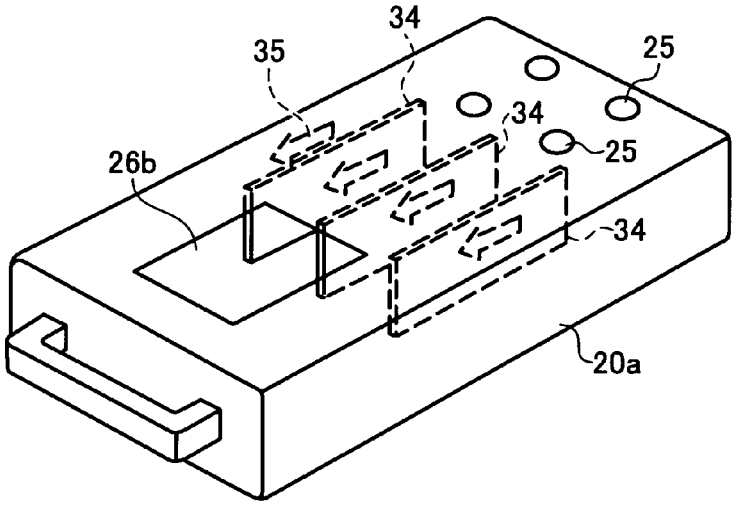
FIG. 19 is a partially clairvoyant perspective view of the structure of a punch-scrap storage box according to a tenth embodiment.

FIG. 19 is a partially clairvoyant perspective view of the structure of a punch-scrap storage box according to a tenth embodiment.

The aligning of airflow by suppressing the spirally wound flow or the turbulent airflow may also prevent the punch scraps from being blown out and may allow the punch scraps to be smoothly sucked. Then, according to the embodiment, straightening vanes 34 are provided in the punch scrap storage box 20*a*. For blocking the spirally wound airflow and producing the airflow proceeding from the punch scrap suction inlet 25 toward the air discharge outlet 26*b*, the straightening vanes 34 are constructed by arranging a plurality of plates in parallel along the proceeding direction. Although the spirally wound airflow is produced in the range from the axial flow fan to the straightening vanes 34, the air flowing through the straightening vanes 34 is restricted by the straightening vanes 34 to be smooth parallel flows 35 along the straightening vanes 34. By aligning the airflow for reducing the generation of the turbulent airflow in such a manner, the blowing out of the suction inlet 25 of the punch scraps PA and the heaping of the punch scraps PA on scrap drift can be prevented.

Other components are the same as those of the seventh embodiment unless otherwise specified.

According to the embodiment, the punch-scrap relay conveying ducts 30 or the punch-scrap storage boxes 20*a* and 21*a*, or both of them are provided with the straightening vanes 34, so that punch-scrap drift due to the turbulent airflow and the blowing out of the suction inlet 25 of the punch scraps can be prevented for smoothly conveying and recovering the punch scraps in order.

Eleventh Embodiment

Figure 20:
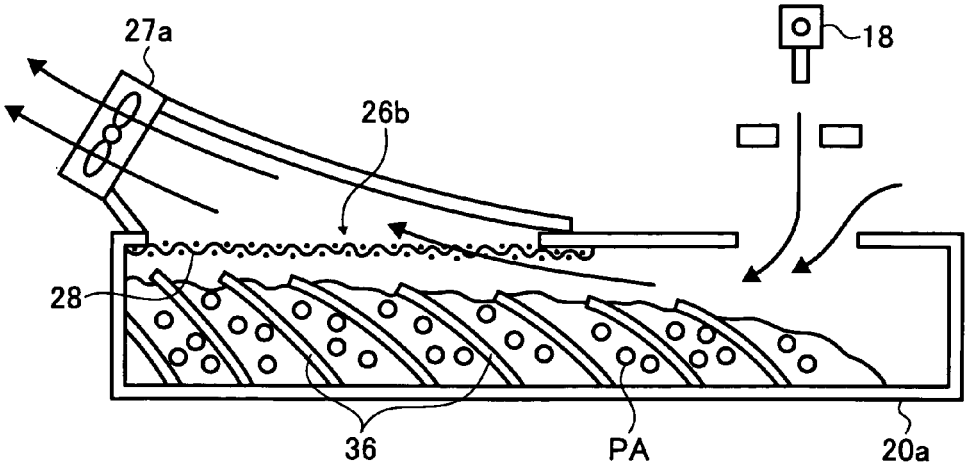
FIG. 20 is a side view of the internal structure of a punch scrap storage box according to an eleventh embodiment.
Figure 21:
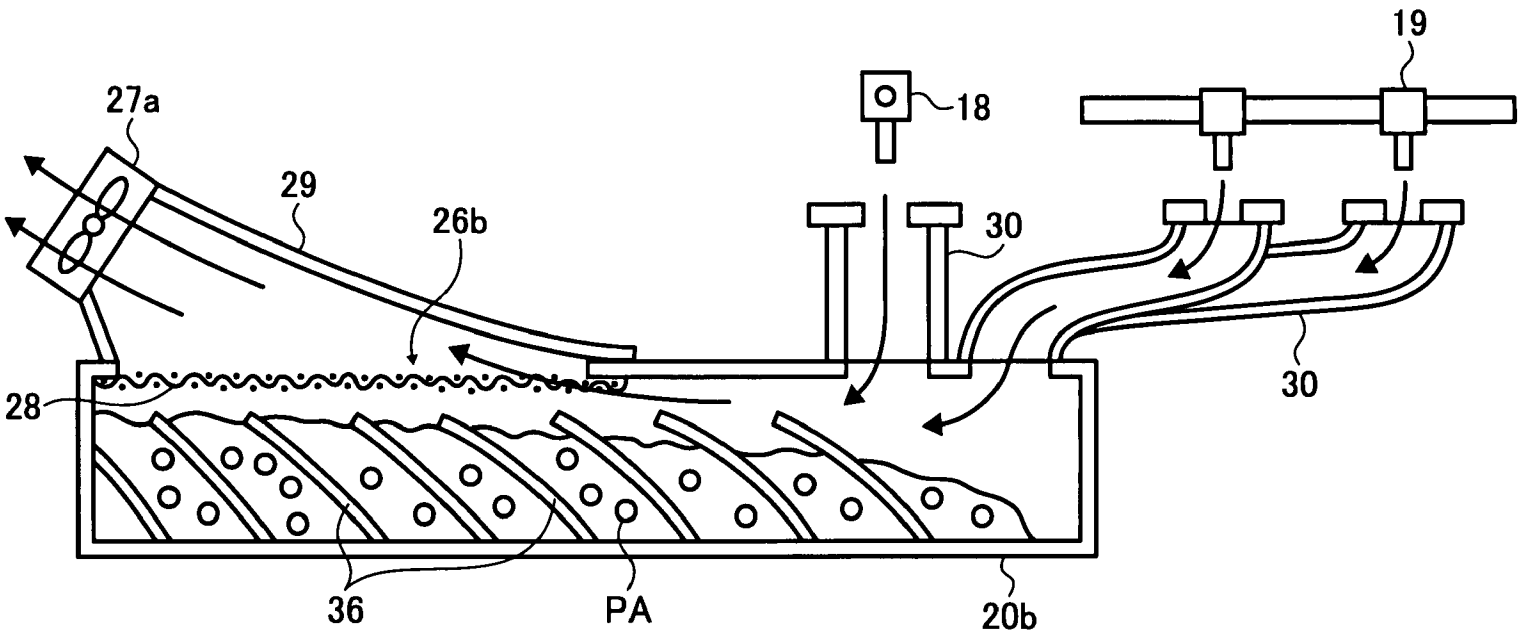
FIG. 21 is a side view of another example of the internal structure of the punch scrap storage box according to the eleventh embodiment.

FIGS. 20 and 21 are side views of the internal structure of punch scrap storage boxes 20*a* and 21*a* according to an eleventh embodiment.

When the punch-scrap storage box forms a blowing duct, the once stored punch scraps PA may block off the air discharge outlet 26*a* by being again stirred with airflow. In such a state, the sucking power is reduced, so that the punch scraps PA may not be sucked before the punch-scrap storage box 20*a* is filled with the punch scraps.

Thus, according to the embodiment, the punch-scrap relay conveying duct 30 or the punch-scrap storage box 20*a*, or both of them are provided with a punch-scrap backflow-prevention partition plate 36, so that the once stored punch scraps PA are difficult to be stirred up. Referring to the drawing, the punch-scrap backflow-prevention partition plate 36 is inclined, so that when the recovered punch scraps PA once move under the punch-scrap backflow-prevention partition plate 36, the airflow is blocked off by the punch-scrap backflow-prevention partition plate 36, and the punch scraps PA become difficult to be stirred up by further being pushed from the above. Thus, even when the amount of the punch scraps in the punch-scrap storage box increases, the punch scraps are sequentially recovered under the punch-scrap backflow-prevention partition plate 36, so that the reduction in sucking power is suppressed from an early time so as to increase an apparent storage capacity.

Other components are the same as those of the sixth embodiment (FIG. 20) or the seventh embodiment (FIG. 21) unless otherwise specified.

According to the embodiment, since the punch-scrap relay conveying duct 30 or the punch-scrap storage box 20*a*, or both of them are provided with the punch-scrap backflow-prevention partition plate 36, the once stored punch scraps PA are prevented from again stirring up so as to adhere to the air discharge outlet 26*b* for reducing the sucking power.

Twelfth Embodiment

FIGS. 24A to 24D are drawings showing a duct shape according to a twelfth embodiment.

Figure 22:
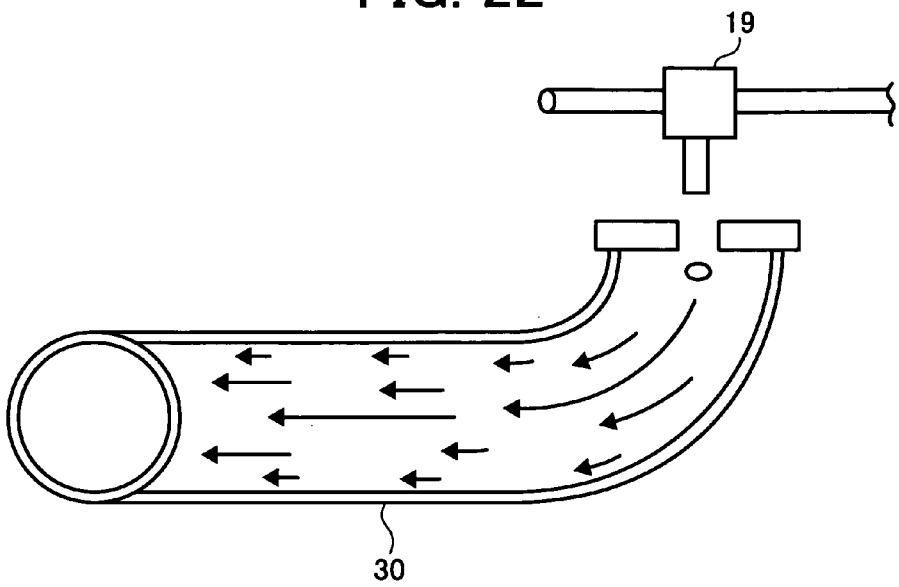
FIG. 22 is a drawing showing an airflow state within a duct.
Figure 23:
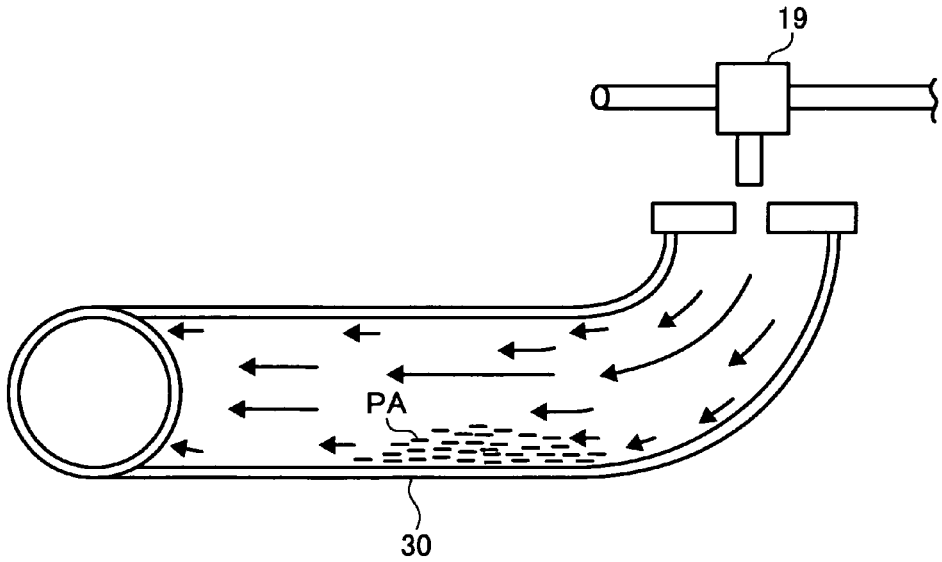
FIG. 23 is a drawing showing an airflow state when punch scraps are heaped in the duct.

In the airflow within the duct, the flow velocity in the vicinity of the duct wall is slower due to the viscosity (see FIG. 22). Thus, the punch scraps once adhered on the inner wall of the duct, especially on the lower wall, may remain there without being simply peeled off. These work as a core so that the punch scraps are sequentially heaped up to defectively stop the flow of the punch scraps PA (see FIG. 23).

Figure 24:
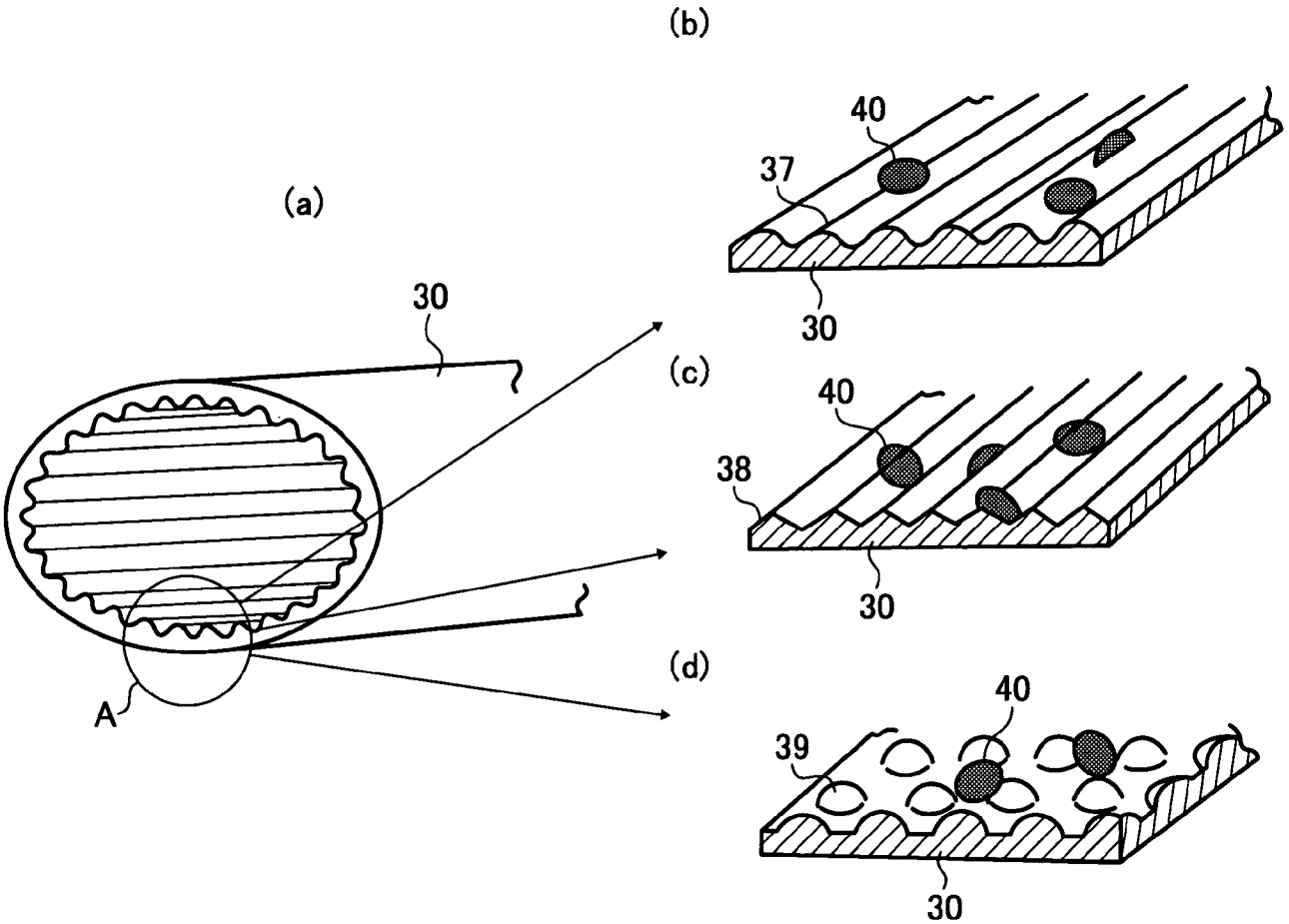
FIGS. 24A to 24D are drawings showing the shape of the duct.

Then, according to the embodiment, for solving such a defect, the inner wall of the duct 30 (30*a*) shown in FIG. 24A is formed in a corrugated surface, which may be a waveform 37 (FIG. 24B), a chevron 38 (FIG. 24C), or a dimple (reverse dimple) 39 (FIG. 24D), the size of the corrugation being smaller than the about 6 mm diameter of the punch scrap. The corrugated surface may be positioned on the whole inner wall or on a lower wall as long as the surface is located at a position where the punch scraps PA tend to be corrected at the minimum. FIGS. 24B to 24D are enlarged views of "A" portion of FIG. 24A.

As described above, when the wall is smooth, the adhering of the punch scraps tends to occur. Whereas, according to the twelfth embodiment, when the inner wall of the duct 30 (30*a*) is formed in a corrugated surface, the size of the corrugation being smaller than the diameter of the punch scrap PA, even when the punch scraps PA drop on the bottom surface, they are not closely adhered on the wall to leave a partial clearance. When such a clearance is produced between the punch scrap PA and the wall, the punch scraps PA tend to soar by receiving air pressure from the below (wall side). FIG. 24A is a perspective sectional view of the relay conveying duct 30.

Other components are the same as those of the seventh and eighth embodiments unless otherwise specified.

According to the embodiment, part or the whole of the inner wall of the duct 30 (30*a*) is formed in a finely corrugated surface, so that the adhesion and heap of the punch scraps PA on the wall are prevented, suppressing the generation of the airflow barrier due to a heaped product as well as reduction in sucking power.

Thirteenth Embodiment

Since the punch scraps are stirred by airflow so as to collide with each other as well as on the wall with friction, static electricity may be easily generated under dry circumstances. Therefore, the punch scraps make a lump and adhere to the wall so as to reduce the sucking power by blocking off the airflow path.

In order to solve such a defect, according to the embodiment, the relay conveying duct or the punch-scrap storage box, or both of them are provided with electrostatic removing device(s). The electrostatic removing device(s) includes a static eliminator sheet, conductive film coating, and a metallic thin film added on the inner wall of the relay conveying duct or the punch-scrap storage box, or both of them, which are made of paper or a resin. Furthermore, for preventing the accumulation of the static electricity, the relay conveying duct or the punch-scrap storage box, or both of them are electrically grounded. Thereby, even when static electricity is generated due to the contact and friction between the punch scraps, when the electricity comes in contact with the wall of the relay conveying duct or the punch-scrap storage box, the electricity is discharged so as to flow through a casing accommodating the relay conveying duct or the punch-scrap storage box, so that lumps and adhesion to the wall of the punch scraps are not generated.

Alternatively, the relay conveying duct or the punch-scrap storage box, or both of them may be made of an electrically conductive material and the casing may be grounded by grounding device(s) so as to form the electrostatic removing device(s). The conductive material may include a sheet metal and a conductive resin.

According to the embodiment, the relay conveying duct or the punch-scrap storage box, or both of them are made of a conductive material and the casing is grounded by the grounding device(s) so as to form the electrostatic removing device(s), so that the reduction in sucking power due to the airflow barrier made of heaped and stuck punch scraps can be prevented.

Fourteenth Embodiment

Figure 25:
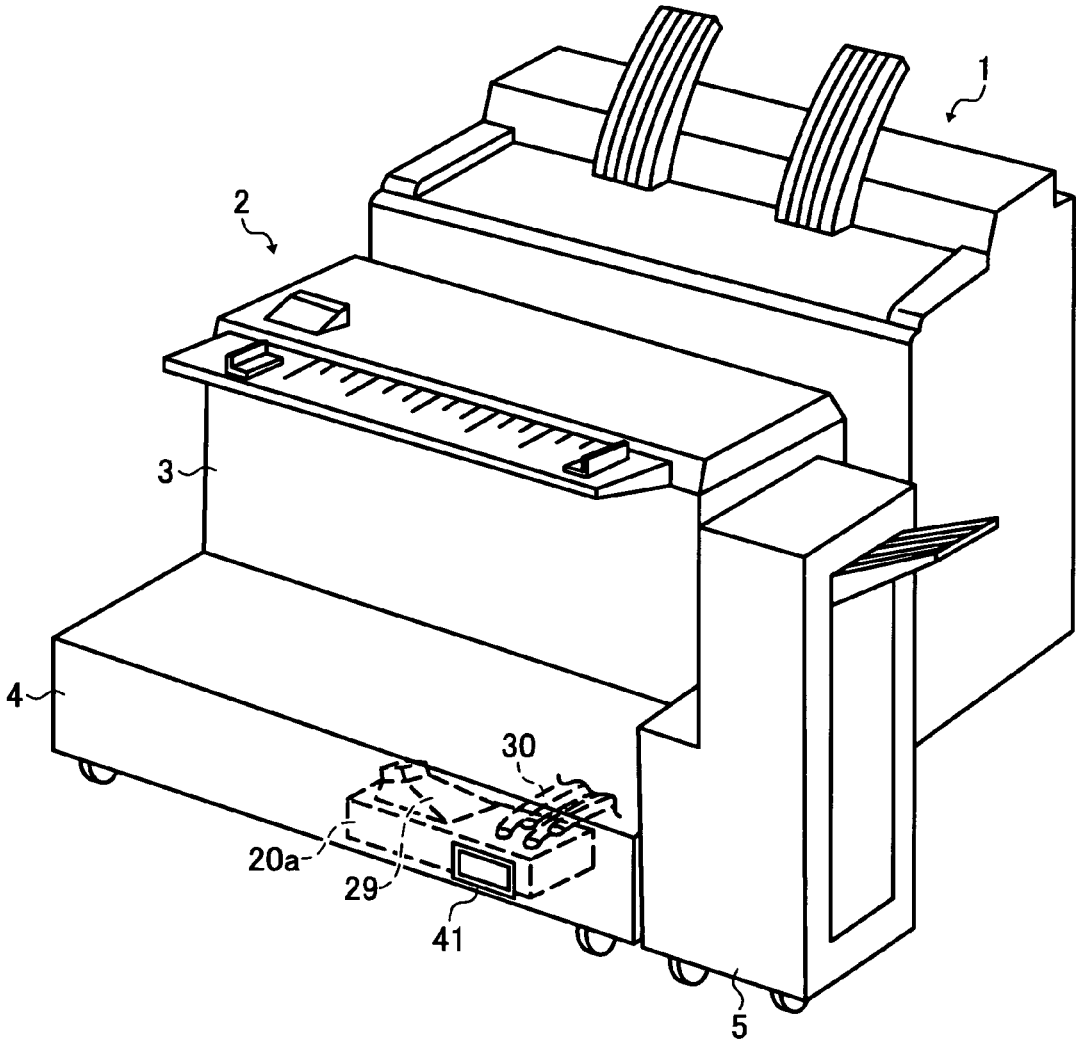
FIG. 25 is a perspective view of a sheet post-processing unit according to a fourteenth embodiment.

FIG. 25 is a perspective view of the whole structure of a sheet post-processing unit 2 according to a fourteenth embodiment. According to the embodiment, there is provided an example in that the storing state of the punch scraps is visible. Thus, according to the embodiment, part or the whole of the punch scrap storage box 20*a* is made of a transparent or translucent material and an inspection window 41 is provided at a predetermined position of the body of the sheet post-processing unit 2.

That is, when the punch scraps PA are sequentially stored in the punch scrap storage box 20*a* toward the full-space, a transparent or translucent part is provided at a position where the final punch scraps are stored while the inspection window 41 is provided at a position of the sheet post-processing unit 2 corresponding to the transparent or translucent part, so that the approach of the full-space with the punch scraps is visualized from the outside the apparatus. In the conveying and recovering system of the punch scraps PA with airflow, the degree of freedom in the arrangement position and shape of the punch scrap storage box 20*a* is large, so that the punch scrap storage box 20*a* is moved close to an armored cover of the sheet post-processing unit 2 and the inspection window 41 is located at a position comparatively easily viewable by an operator. In this case, the whole of the punch scrap storage box 20*a* may be made of a transparent or translucent, or quasi-material; alternatively, only part at the position corresponding to the inspection window may also be made of a transparent or translucent, or quasi-material.

By such a structure, the full-space detecting device(s), such as a sensor, that is normally necessary can be eliminated to reduce cost. However, the punch scrap storage box 20*a* of the sheet post-processing unit 2 and its inspection window are generally located at a position separated from the operation panel normally viewed by an operator, so that the full-space may be oddly missed. Then, it is preferable that the full-space detection by a normal optical sensor be used together.

Some applications may be applied.

Namely, in the conveying and recovering system of the punch scraps PA with airflow, errors in full-space detection and variations in detected amount may occur so that problems, such as the clogging due to the reduction in sucking power and early lighting long before the full-space, have arisen. Then, a combination system may be adopted in that the full-space detection is lighted by conventional full-space detection device(s) at a time little while earlier than the full-space so as to prompt an operator in doing visual observation for confirmation of the punch scrap recovery situation, so that the discharge operation of the punch scraps may be performed at a reasonable time.

Other components are the same in structure and function as those of the seventh embodiment shown in FIGS. 12 and 13 unless otherwise specified.

According to the embodiment, part or the whole of the punch scrap storage box 20*a* is made of a transparent or translucent material and an inspection window is provided at a predetermined position of the body of the sheet post-processing unit 2, so that the punch scrap full-space detection is enabled by visual confirmation, thus providing inexpensive and simplified full-space detection device(s).

Fifteenth Embodiment

Figure 26:
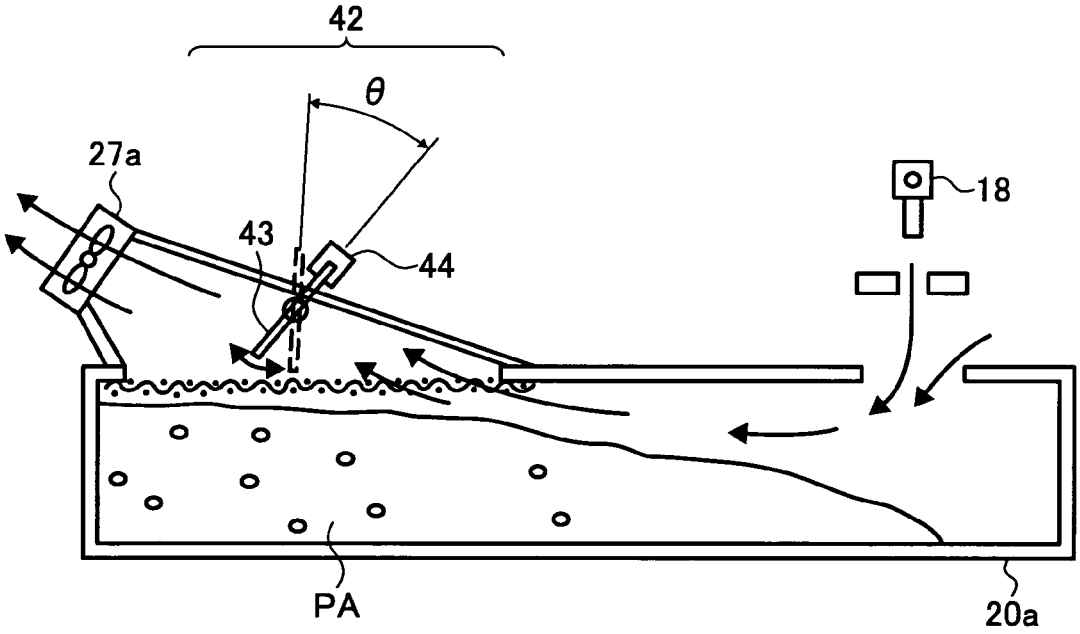
FIG. 26 is a side view of the internal structure of a punch scrap storage box according to a fifteenth embodiment.

FIG. 26 is a side view of the internal structure of a punch scrap storage box 20*a* according to a fifteenth embodiment.

In the sheet post-processing unit 2 sucking and recovering the punch scraps with airflow, if the sucking power is reduced smaller than a predetermined level, the punch scraps PA cannot be sucked and recovered. If such a situation occurs before the full-space of the punch scrap storage box 20*a*, the punch scraps PA are heaped in the relay conveying duct 30, so that they may overflow out of the relay conveying duct 30 due to the clogging. According to the embodiment, for preventing this problem, the sucking power is directly detected to prompt an operator in doing discharge of the punch scraps PA by informing about the full-space detection.

That is, as shown in FIG. 26, according to the embodiment, an airflow detection sensor 42 is provided at a position within the air inducing duct 29 on the upstream side of the air sucking device(s) (fan) 27*a* where is not affected by the punch scraps PA. The airflow detection sensor 42 uses a filler and a photo-interrupter, for example. Namely, a filler 43, in which the angle θ is varied by the airflow received, is provided along the airflow path, and when the filler angle is reduced smaller than a predetermined value due to the reduction in sucking power of the fan 27, the detection element of the filler 43 is deflected from the optical path of an optical sensor (photo-interrupter) 44 so that the optical sensor 44 is turned on so as to detect the movement of the filler 43. The airflow detection sensor 42 may also use an available airflow detection sensor instead of the filler 43 and the optical sensor 44. This embodiment may be incorporated in the length-punch scrap storage box 20*a* using the air inducing duct 29 according to the sixth and subsequent embodiments. When the reduction in sucking power is detected by the airflow detection sensor, the controller 100 turns on the display 45 for informing an operator of the detection.

According to the embodiment, the airflow detection sensor 42 and the full-space detection display 45 are provided, so that before the punch-scrap defective recovery is generated due to the reduction in sucking power, the full-space detection display 45 is turned on for prompting punch scrap handling.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sheet processing device comprising:

a punch processor housed within walls of the sheet processing device and located along a paper conveying path formed by rollers, the punch processor being configured to perform punch-processing on a conveyed sheet member;

a punch-scrap storage box housed within walls of the sheet processing device and located directly below the punch processor, the punch-scrap storage box being configured to store punch scraps produced by the punch-processing and dropped from the punch processor;

an air-sucker housed within walls of the sheet processing device and located above the punch-scrap storage box, the air sucker being configured to convey the punch scraps produced by the punch processor; and an air inducing duct fixed at a first end to the air-sucker and at a second end to an opening on a top surface of the punch-scrap storage box, wherein the second end is larger than the first end and the air sucker and the air inducing duct are configured to distribute the punch scraps throughout the punch-scrap storage box thereby preventing heaping of the punch scraps at a scrap dropping point located under the punch processor.

2. The device according to claim 1, wherein at least part of the punch-scrap storage box is made of at least one of a transparent and translucent material, so that the storage state of punch scraps are viewable from the outside.

3. The device according to claim 1, wherein the punch-scrap storage box constitutes an air distribution duct having a punch-scrap suction inlet and an air discharge outlet, and the air-sucker is arranged at the air discharge outlet.

4. The device according to claim 3, wherein the air inducing duct is provided on a downstream side of the airflow direction of the air discharge outlet and on an upstream side of the airflow direction of the air-sucker.

5. The device according to claim 3, wherein the air discharge outlet and the air-sucker are arranged above the punch-scrap storage box so that airflow is generated in an upper portion within the punch-scrap storage box.

6. The device according to claim 5, wherein the airflow is generated before the punch scraps drop and the airflow is stopped before the punch scraps adhering to the punch-scrap separator become lodged against the punch-scrap separator.

7. The device according to claim 1, further comprising a punch-scrap separator, arranged on an upstream side of the air flowing direction of the air-sucker, to separate punch scraps from the air conveying the punch scraps.

8. The device according to claim 1, further comprising:

an air sucking power detector; and a full-space detection display.

9. An image forming apparatus comprising the sheet processing device according to claim 1.

10. The device according to claim 1, wherein the sheet processing device is a sheet post-processing device of an image forming apparatus and the conveyed sheet member is a paper sheet.

11. The device according to claim 1, wherein a cross-section of the punch-scrap storage box has a height that is less than the width.

* * * * *